United States Patent [19]

Arnold

[11] 4,030,270

[45] June 21, 1977

[54] PACK-FORMING APPARATUS

[75] Inventor: Robert Harry Arnold, London, England

[73] Assignee: The Metal Box Company Limited, England

[22] Filed: June 27, 1975

[21] Appl. No.: 591,005

[30] Foreign Application Priority Data

June 29, 1974 United Kingdom ..... 28972/74

[52] U.S. Cl. ..... 53/183

[51] Int. Cl.[2] ..... B65B 5/02; B65B 9/10

[58] Field of Search ..... 53/183, 187, 384, 52

[56] References Cited

UNITED STATES PATENTS

| | | | |
|---|---|---|---|
| 3,432,986 | 3/1969 | Schneider et al. | 53/183 X |
| 3,445,982 | 5/1969 | Schweikert | 53/187 X |
| 3,462,913 | 8/1969 | Bodolay et al. | 53/183 |
| 3,740,922 | 6/1973 | Liou | 53/384 X |
| 3,792,565 | 2/1974 | Goransson | 53/183 |

*Primary Examiner*—Robert Louis Spruill
*Attorney, Agent, or Firm*—Diller, Brown, Ramik & Wight

[57] ABSTRACT

A packaging machine into which goods may be loaded and which can wrap the goods so loaded, by operation of its various pack-forming elements according to a predetermined sequence, has drive means which are essentially mechanical in character, the sequence being automatic and controlled principally by rotatable elements all deriving power from the same power unit. In one form, the machine is constructed so as to be suitable for making a succession of packs all of the same length, while in another form it is adapted for making packs which vary in length between one pack and another. In its latter form, the machine is particularly suitable for use at check-out points in consumer product selling establishments such as supermarkets.

19 Claims, 31 Drawing Figures

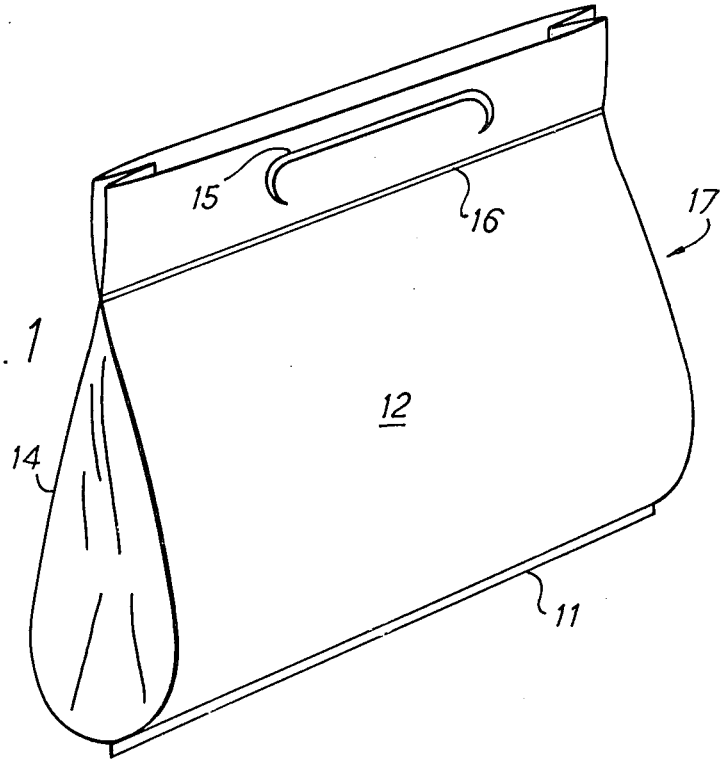
FIG. 1
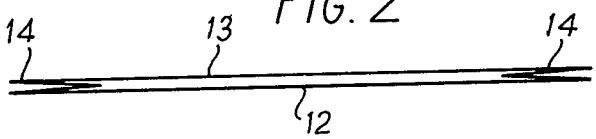
FIG. 2
FIG. 3
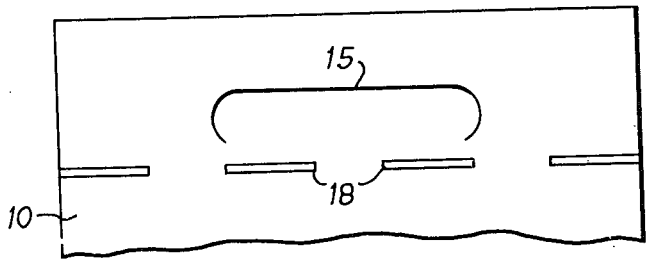

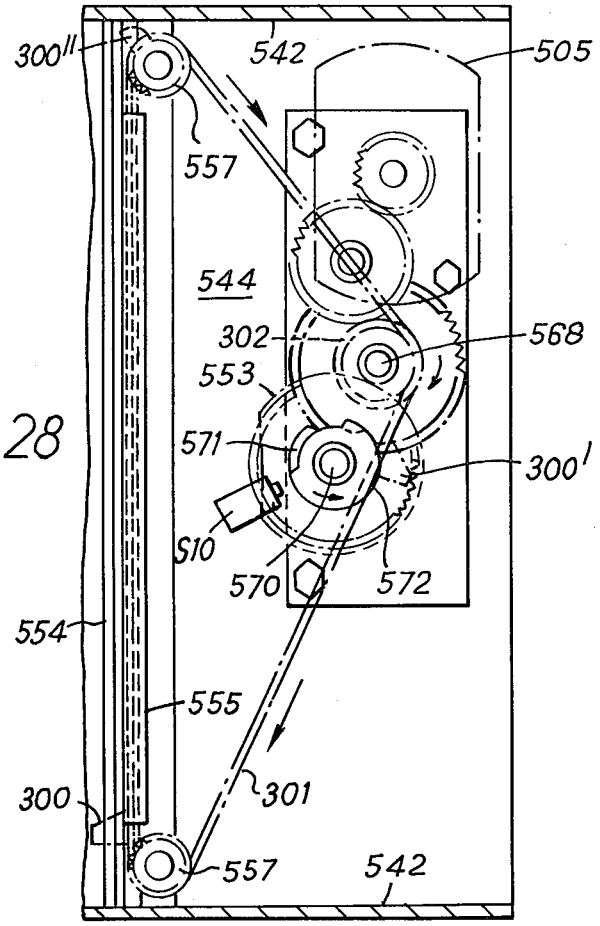
FIG. 28
FIG. 29
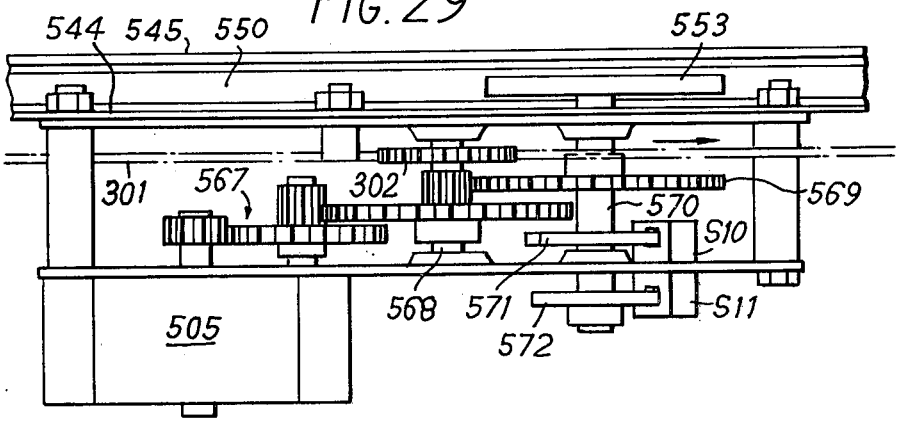

PACK-FORMING APPARATUS

This invention relates to packaging apparatus for forming successive packs each comprising a length of flexible tubular wrapping material closed at a first end thereof and containing goods, said length of material having a terminal second end, said apparatus having pack-forming elements for handling said material in forming said packs, the apparatus including pack support means for supporting each successive said length of material at said first end with said first end closed, and the pack-forming elements including holding means for holding open said second end of each successive said length of goods to be loaded therethrough. Such an apparatus will be referred to in this specification as "apparatus of the kind hereinbefore specified".

The expression "flexible tubular wrapping material" as used in this specification (the expression being used in both the body of the specification and the claims appended thereto) is to be understood to mean material such as platics or cellulose film, or paper, the material being in the form of a single layer or a plurality of layers, formed into a tube or sheath. The term "web" is to be understood to refer to such a tube or sheath comprising a pair of opposed walls, said walls being either in mutually overlying juxtaposition as when the tube or sheath is flattened, or, according to the context, spaced apart laterally of the tube or sheath. The material of the tube or sheath, where it consists of a plurality of layers, may be laminated and the various layers may consist of materials different from each other. The tube or sheath constituting the web may include, and preferably does include, longitudinally-extending side gussets joining the said opposed walls together. One typical and well-known example of a web of flexible tubular wrapping material, in the sense in which these expressions are used herein, is seamless "lay-flat" gussetted tubing formed in a continuous length by extrusion of polyethylene film.

According to the invention, apparatus of the kind hereinbefore specified has main drive means including main cam means arranged to be releasably coupled through first mechanical coupling means with a power unit, said first coupling means being engageable and disengageable according to a sequence determined by the rotational position of at least one rotatable element arranged to be driven from the power unit, the apparatus having means for operatively connecting said main cam means with said pack-forming elements whereby the latter are actuated according to said sequence.

Thus in its broadest sense the invention provides apparatus, typically in the form of a packaging machine, into which goods may be loaded and which can wrap the goods so loaded, by operation of its various pack-forming elements according to a predetermined sequence, the drive means of the apparatus being essentially mechanical in character and the sequence being automatic in the sense that it is controlled principally by rotatable elements all deriving power from the same power unit.

Preferably the main cam means itself includes at least one of said rotatable elements associated with feedback means operable to engage and disengage said first mechanical coupling means according to the rotational position of said at least one rotatable element.

Preferably the main drive means includes a first drive shaft coupled to the power unit for rotation thereby whenever the power unit is operating, the main cam means including a plurality of actuating cams for actuating pack-forming elements of the apparatus, and the main cam means being coupled to the first drive shaft through said first coupling means, for simultaneous rotation upon engagement of the said first coupling means.

According to a preferred feature of the invention, the holding means includes at least one pair of opposed jaws, whereof each jaw of a pair has a web-engaging face disposed facing the web-engaging face of the other jaw of the pair, both jaws of said pair being arranged for simultaneous movement between an open position, for holding open an end web portion adjacent said second end of a said length of wrapping material, and a closed position in which such an end web portion can be trapped in a flattened condition between the pair of jaws.

The apparatus preferably includes as a said pair of jaws a pair of upper jaws, each having a rigid transverse jaw bar including the respective said web-engaging face, and the holding means then includes clamping means associated with each of the upper jaws, and clamp-actuating means for moving said clamping means with respect to the associated jaw between a first position clear of the jaw and a second position for clamping part of said end web portion of the wrapping material against the web-engaging face of the jaw.

In preferred forms of the apparatus according to the invention, the clamp actuating means include camming means mounted in a fixed location in the apparatus, adjacent the corresponding jaws, the clamping means having a cam-engaging element for engaging the camming means, so as to move the clamping means between said first and second positions thereof in response to movement of the said jaws between their open and closed positions.

Preferably, in an apparatus according to the invention the holding means includes a pair of sealing jaws, each sealing jaw having a web-engaging face disposed facing the web-engaging face of the other jaw of the pair, and both sealing jaws being arranged for simultaneous movement between an open position, in which a web portion of a said length of material extending transversely with respect to the sealing jaws can lie open between them, and a closed position in which said web portion can be trapped in a flattened condition between the sealing jaws, at least one said sealing jaw having sealing means for joining together the two opposed walls of a web portion so flattened, whereby to close at least partially the said web portion.

The sealing jaws preferably carry handle-forming means for creating in a said web portion of wrapping material means for defining a carrying handle for the pack.

The holding means preferably includes frame means having parallel side members defining jaw guide means for movement of the jaws thereon between their open and closed positions.

Preferably, the jaw guide means are so arranged with respect to a central transverse plane defined between the jaws of a said pair in the closed position thereof, that movement of the jaws of the or each pair towards said plane has a vertical component.

While the apparatus may be so arranged that a completed pack can be lifted vertically out past the holding means, the apparatus preferably has ejector means for removing each completed pack in succession from the pack support means. According to a preferred feature of the invention, the apparatus is characterised by such ejector means and by second mechanical coupling means whereby the ejector means can be coupled to the power unit and uncoupled therefrom.

Typically the ejector means, in general terms, includes an ejector body having a pack-engaging element movable across the pack support means, the ejector body having drive-engaging means for engagement with an ejector drive element which is coupled with the output side of the second coupling means and which is arranged to drive the ejector body in a forward stroke across the pack support means for removal of a pack therefrom and a return stroke to retract the ejector body.

Apparatus according to the invention, as set out thus far in this specification, may be employed for making packs using wrapping material which is uspplied either in the form of a continuous length from which shorter lengths can be taken as required for each pack in turn, or in the form of separate lengths of the wrapping material in flattened condition.

In the former case, the apparatus may incorporate a suitable device for separating the lengths of material for the packs from the supply. In one example this supply is in the form of a coil or reel of the material; in another example it is a long length of the flattened material comprising a plurality of portions each comprising one pack length of the material, the pack lengths being joined at fold lines, whereby they are folded back to back to form a "block" from which the leading end of the leading pack length can be led via the pack support means to the holding means of the apparatus. Such a "block" may be accommodated in a magazine of known type.

The pack lengths may be joined by lines of weakness, such as perforations, so that each completed pack can be separated from the next by tearing along the line of weakness. This could conveniently be achieved, for example, by lifting the completed pack upwards through the holding means, pulling new material from the coil, reel or "block" up so that its leading end is adjacent the holding means, and then operating the holding means, or setting the main drive means to operate the holding means so that the latter clamps the front end portion of the new material. The completed pack can then easily be torn from it.

Where ejector means are provided to eject a completed pack otherwise than upwardly through the holding means, it is necessary, if the wrapping material comes from a continuous supply, to separate the bottom of the completed pack before ejection; in this case a suitable cutting device needs to be provided in association with the pack support means.

If the supply of new wrapping material is not in the form of a continuous supply but consists of separate lengths of the material, these may for example be in the form of premade bags, each closed at the bottom end; the separate lengths of wrapping material may conveniently be arranged in a stack or block in a suitable magazine, with a suitable take-off device of known kind for feeding one bag at a time to the holding means.

However, in preferred embodiments of the invention, apparatus according to the invention includes:

1. means for supporting a reel carrying a web of flattened tubular flexible wrapping material, the pack support means being arranged for the flattened web of said material to extend from such a reel through the pack support means, whereby a leading portion of said web above the pack support means may be opened out and held by the holding means of the apparatus and, whilst so held, loaded with goods;
2. releasable lower gripping means, controllably by the main drive means, for holding the lower end of a said leading web portion closed;
3. lower sealing means for sealing the said lower end;
4. cutting means controllable by the main drive means, for cutting said leading web portion from the remainder of the web extending from a said reel; and
5. rotatable feed roller means operable by the main drive means for bringing the holding means and a free leading end of a said web into engageable juxtaposition with each other, the lower gripping means, lower sealing means and cutting means being associated with the pack support means.

The first coupling means, which, it will be recalled, connects the main cam means with the power unit, is preferably in the form of a single first clutch which is engageable and disengageable by means responsive to rotation of rotatable members driven from the power unit. Similarly where ejector means are provided and, as proposed hereinbefore, are driven from the power unit through second coupling means, the latter preferably comprises a second clutch, which may conveniently be of the same type as the first clutch, which may conveniently coupled on its driving side to the first drive shaft and on its driven side with the ejector means.

The (or each) clutch is preferably of a torsion spring kind wherein a driving member and driven member, rotatable relative to each other, are connectible by a torsion clutch spring fixed to a first of said members and normally in frictional driving engagement around a sleeve portion of the other of said members, the clutch having an actuating member for permitting the clutch spring to come into such frictional driving engagement with said sleeve portion. In preferred embodiments, solenoid-operated trigger means are associated with the or each clutch having a said actuating member, the arrangement being such that energization of the or each solenoid causes the respective trigger means, in co-operation with the actuating member of the corresponding clutch, to permit the clutch spring to wind up into frictional driving engagement with said sleeve portion.

The lower gripping means, mentioned earlier herein in connection with preferred embodiments of the invention, preferably comprise a pair of lower jaws, at least one of which is movable towards and away from the other, the lower sealing means comprising heating means disposed transversely in a web-engaging face of at least one of the lower jaws to provide, when energized, a transverse weld seam across a web of wrapping material when such a web extends upwardly between the lower jaws.

It will be realized that apparatus according to the invention, as proposed in all of the foregoing, may be constructed so as to be suitable for making a succession of packs all of the same length. In such a case the pack support means will be arranged a fixed distance from the hodling means, at least throughout the loading operation; and the lengths of wrapping material used for the packs will usually all be of the same length as each other.

Apparatus for making packs all of the same length may be called "constant-length pack apparatus".

However, apparatus according to the invention may also be adapted for making packs which vary in length between one pack and another and apparatus so adapted may be called "variable-length pack apparatus". This latter term is to be understood as being limited to apparatus in which (*a*) the wrapping material is supplied to the pack supporting means and holding means from a continuous supply (for example a reel or coil) as discussed hereinbefore and generally applicable to constant-length as well as variable-length pack apparatus, and (*b*) relative movement between the lower gripping means and the holding means is possible so that the length of the leading web portion can be increased whilst the goods are being loaded into it.

One particular known kind of variable-length pack apparatus comprises a machine for use in the wrapping of goods, said machine including a chamber having an upwardly facing open mouth, means within the chamber and adjacent the open mouth for holding open an end of a tube of heat-sealable material advanced from a supply, and sealing jaws disposed within the chamber for sealing the tube at a position spaced from the end thereof, said sealing jaws being movable away from the open mouth of the chamber whereby the position at which sealing of the tube is effected may be varied in dependence on the amount of goods being wrapped. Such a machine will be called "variable-length pack apparatus of the kind specified". An important feature of such an apparatus is the provision of lower gripping means gripping the tube or web at the bottom of the leading or bag-forming portion thereof, the lower gripping means being so arranged that it can be lowered during loading of the goods so as to extend the bag to the length required for the particular amount of goods being loaded.

Variable-length pack apparatus of the kind specified is particularly suitable for use at checkout points in consumer product-selling establishments, such as supermarkets and the like. Typically each apparatus will be associated with a cash register and will be under the control of a cashier, who loads goods, selected by each customer in turn, into the apparatus, the apparatus then being operated to wrap the goods and eject the finished pack.

Some optional subsidiary features of the present invention, for adapting apparatus according to the present invention for use as variable-length pack apparatus, will now be mentioned.

According to a preferred feature of the invention, in an apparatus of the preferred kind described above and having (1) means for supporting a reel; (2) lower gripping means; (3) lower sealing means; (4) cutting means; and (5) feed roller means, the apparatus is characterised in that the pack support means comprises a table unit, movable by the main drive means vertically up and down below the holding means and including a pack-supporting surface, the lower gripping means, lower sealing means, cutting means and feed roller means.

Such an apparatus will be called "variable-length pack apparatus of the invention".

In such an apparatus, the table unit is preferably carried by a plurality of fixed flexible elongate elements arranged in tension and extending generally along the vertical path of movement of the table unit, each said elongate element extending around freely-rotatable means of the table unit, whereby the table unit is supported on the elongate elements. The main drive means preferably includes winding means, connected with the table unit by an elongate flexible member such as a cable, and with the power unit through third mechanical coupling means. When this coupling means, which is engageable and disengageable, is engaged, the winch can raise the table unit by exerting an upward pull on the cable.

Furthermore, to provide a facility for lifting the table unit by a relatively small predetermined amount so as to enable some slack to be available in the wrapping material, for example when the top end of the web is being closed after the loading operation, there is preferably provided as part of the winding means, a lift lever, pivoted for movement in response to rotation of a said actuating cam, and having an element around which the said elongate flexible member extends whereby, upon the lever executing said pivotal movement, an upward pull can be exerted thereby in the elongate flexible member so as to lift the table unit by a limited predetermined amount.

The third releasable coupling means is preferably a third clutch, operatively coupled on its driving side to the first drive shaft and on its driven side with the winch for rotation of the winch. This third or winch clutch may be of the same kind as generally described hereinbefore with reference to the first (cam) and second (ejector) clutches; it is however convenient to modify the third clutch so as to enable the winch to unwind the cable in response to lowering of the table by other means, such as a pedal controlled by the cashier, during the loading operation.

Various embodiments of the invention will now be described by way of example, with reference to the accompanying drawings of which:

FIG. 1 is a general view of a typical pack made in apparatus of the invention;

FIG. 2 is an end view of a side-gussetted lay-flat tube of plastics film wrapping material;

FIG. 3 is a side elevation of the top portion of another pack made in apparatus of the invention;

FIG. 28 is an inverted plan on the line XXVIII—XXVIII in FIG. 25 with certain parts omitted for clarity;

FIG. 29 is an elevation viewed from the right-hand side of FIG. 28;

Figure 4:
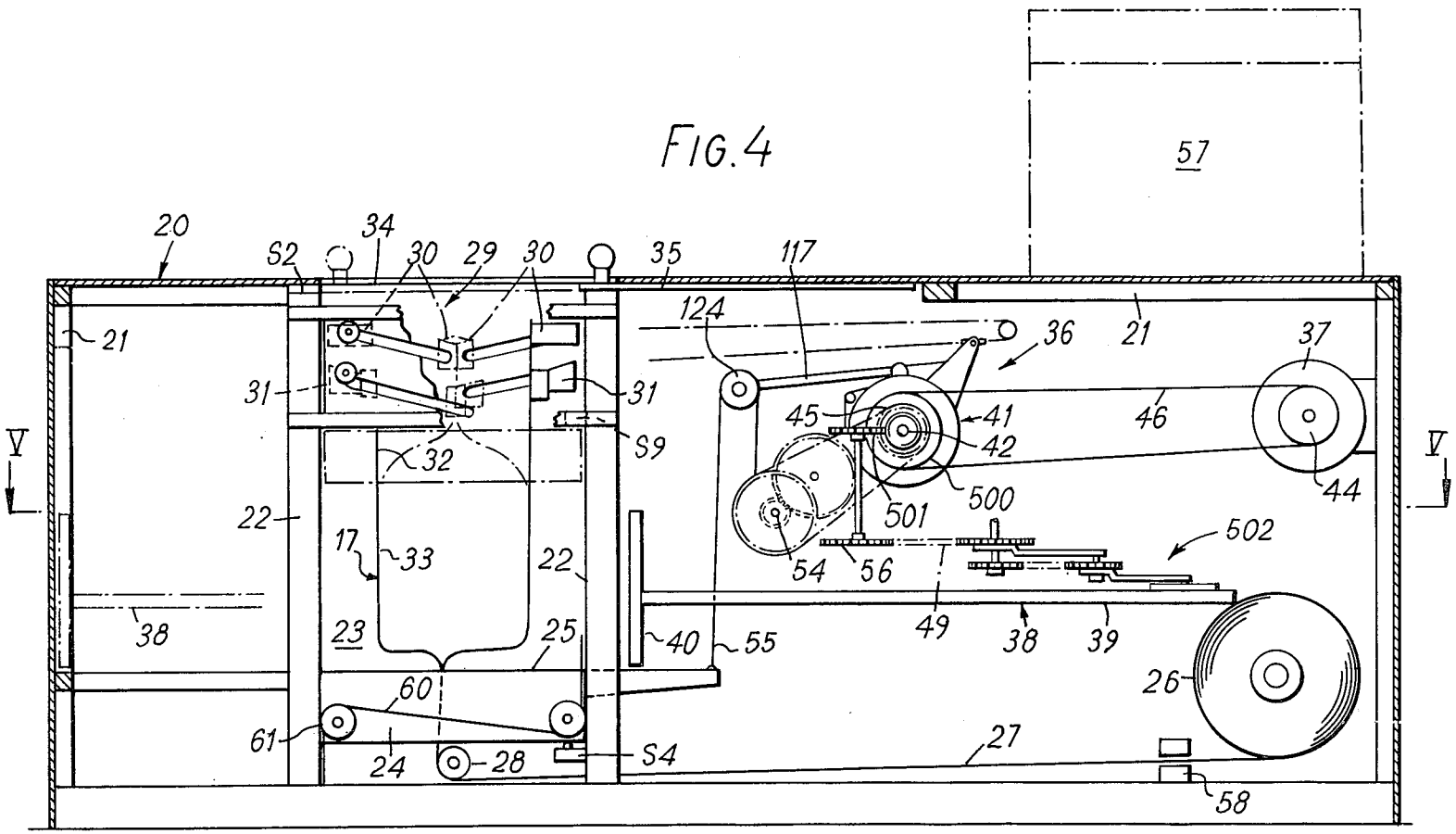
FIG. 4 is a much simplified and somewhat diagrammatic sectional side elevation of one apparatus of the invention, being a variable-length pack apparatus.

Referring first to FIGS. 1 and 2, the pack 17 shown in FIG. 1 comprises goods contained in a sealed bag 10 in the form of a length of flexible tubular wrapping material closed at the bottom end by a transverse weld seam 11. In this example the wrapping material is polyethylene film, supplied in the form shown in FIG. 2, as lay-flat seamless tubing flattened to form two side walls 12, 13 joined by side gussets 14.

The pack has in this example a handle, defined by slits 15 in the form of a straight line having at each end an end portion in the form of a "C" directed generally downwards. The slits are formed in an end portion of both walls 12 and 13. Below the handle 15 and above the goods, there is a transverse weld seam 16 extending across the bag to provide strength for the pack and to hold the two halves of the handle together, besides sealing the goods within the bag.

FIG. 3 shows the top part of a pack modified in that the upper weld seam 18 is discontinuous.

Except where otherwise stated or evident from the context, in the description that follows any references to a bag or pack refer to a bag or pack generally as shown in FIG. 1, with or without the handle slits 15 and with either the continuous upper weld seam 16 or the discontinuous seam 18 of FIG. 3. References to the "web" mean tubing generally as above described with reference to FIG. 2.

GENERAL DESCRIPTION OF APPARATUS

Figure 5:
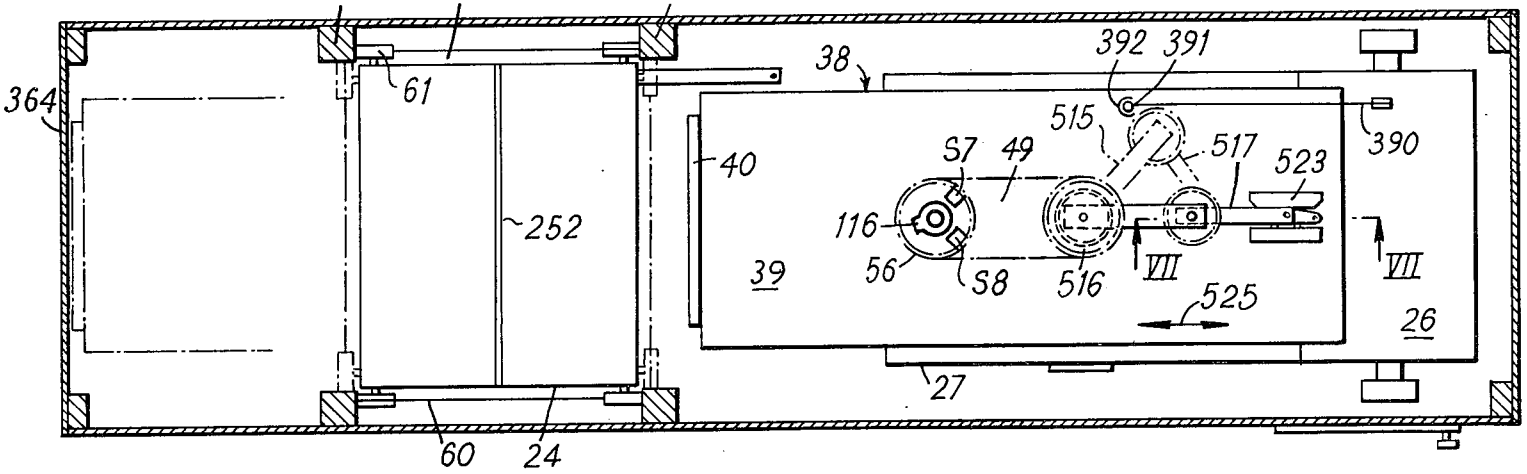
FIG. 5 is a simplified sectional plan view taken on the line V—V in FIG. 4.

Referring now to FIGS. 4 and 5, the apparatus shown diagrammatically therein is a packaging machine, for forming a succession of packs and comprising a cabinet 20 having a fixed main frame 21 which includes four vertical pillars 22 defining between them a loading chamber 23. Shown at the bottom of the loading chamber 23 is a pack support table unit 24 having a flat top surface 25. A reel 26 of the web material is freely-rotatably in the main frame 21; and from it the web 27 passes around an idler roller 28 and up through the center of the pack support surface 25. At the top of the loading chamber 23 a holding means, generally indicated at 29, comprises a sub-assembly, which includes a pair of upper jaws 30 and a pair of intermediate or sealing jaws 31 arranged below the upper jaws.

As will become evident hereinafter, the holding means 29 are provided for holding open, in turn, a free end 32 of each of a succession of lengths 33 of the web 27, the bottom end of each said length being supported by the table unit 24. While the free end 32 is so held open, goods can be loaded into the web length 33 through a top opening 34 of the cabinet. The top opening 34 has a sliding shutter 35.

Within the main frame 21 is a main drive unit 36 and an electric motor 37. Also within the frame is an ejector 38, comprising an ejector body 39 with a pusher plate 40 at its leading end, for removing each completed pack in succession from the pack support surface 25.

The pack support table unit 24, which will be described later herein, includes releasable lower gripping means such as a pair of jaws 259, 260 (FIG. 25) for holding the lower end of the leading web length 33 in a closed or flattened condition; lower sealing means in the form of a heat sealing device, not shown, which may be of conventional form, for sealing the lower end of the web portion 33; and cutting means in the form of a knife 300 (FIG. 28) for cutting the web portion 33, so sealed, from the remainder of the web 27 extending from the reel 26.

Means for bringing the holding means 29 and the free leading end of the web portion 33 into engageable juxtaposition with each other are also provided, so that the holding means 29 can open out the free end and hold it open for loading with goods. In this example this is achieved by arranging the table unit 24 so as to be movable vertically up and down in the loading chamber 23 below the jaw sub-assembly 29.

The main drive unit 36 which will be described more fully later herein includes main cam means 41 in the form of several rotatable actuating cams on a common camshaft, which is coupled through a first mechanical coupling means in the form of a cam clutch 90 (FIG. 9), to a first drive shaft 42 driven through pulleys 44, 45 and a belt 46 by the motor 37. The actuating cams engage follower elements constituting part of respective mechanical or electrical actuating or controlling systems for various pack-forming elements of the machine. In this example these pack-forming elements include the upper jaws 30, intermediate jaws 31, and the above-mentioned lower gripping jaws and cutting means.

The table unit 24 is itself another of the said pack-forming units in that it can optionally be raised by action of one of the actuating cams, though as will be seen hereinafter the raising and lowering of the table unit is achieved principally by means independent of the actuating cams.

Figure 7:
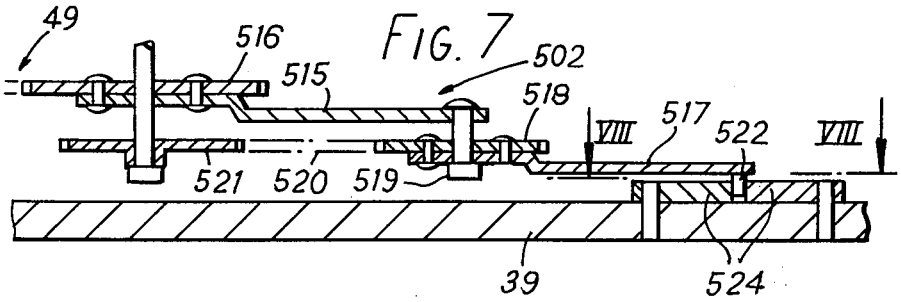
FIG. 7 is an enlarged sectional elevation on the line VII—VII in FIG. 5, showing part of an ejector and its drive.
Figure 8:
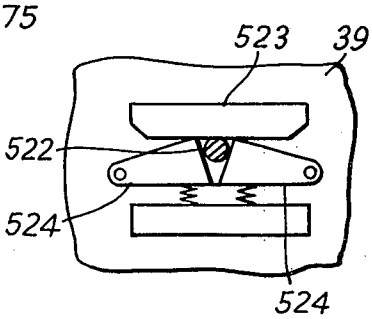
FIG. 8 is a plan view on the line VIII—VIII in FIG. 7.

The main drive unit 36 also includes a second mechanical coupling means (FIG. 9) in the form of an ejector clutch 47 which when engaged couples the first drive shaft 42 (and therefore the motor 37) to a worm 500 which drives, through a worm gear 501 and the chain drive generally indicated at 49, an ejector actuating mechanism indicated at 502 and described more fully hereinafter with reference to FIGS. 7 and 8.

When the clutch 47 is engaged, one cycle of movement of the mechanism 502 moves the ejector 38 to the left (as seen in FIGS. 4 and 5) across the pack support surface 25 to its extended position shown in broken lines, to eject a finished pack from the loading chamber 23, and then returns the ejector to its original position.

In this example there are also provided in the table unit 24 feed rollers 272, 273 (FIG. 25) for feeding the web 27 upwards through the table unit 24 to the jaw subassembly 29.

The knife 300 (FIG. 28) is driven (as will be more fully described hereinafter) by an auxiliary electric motor 505 in response to movement of one of the cams of the main cam means 41.

Figure 9:
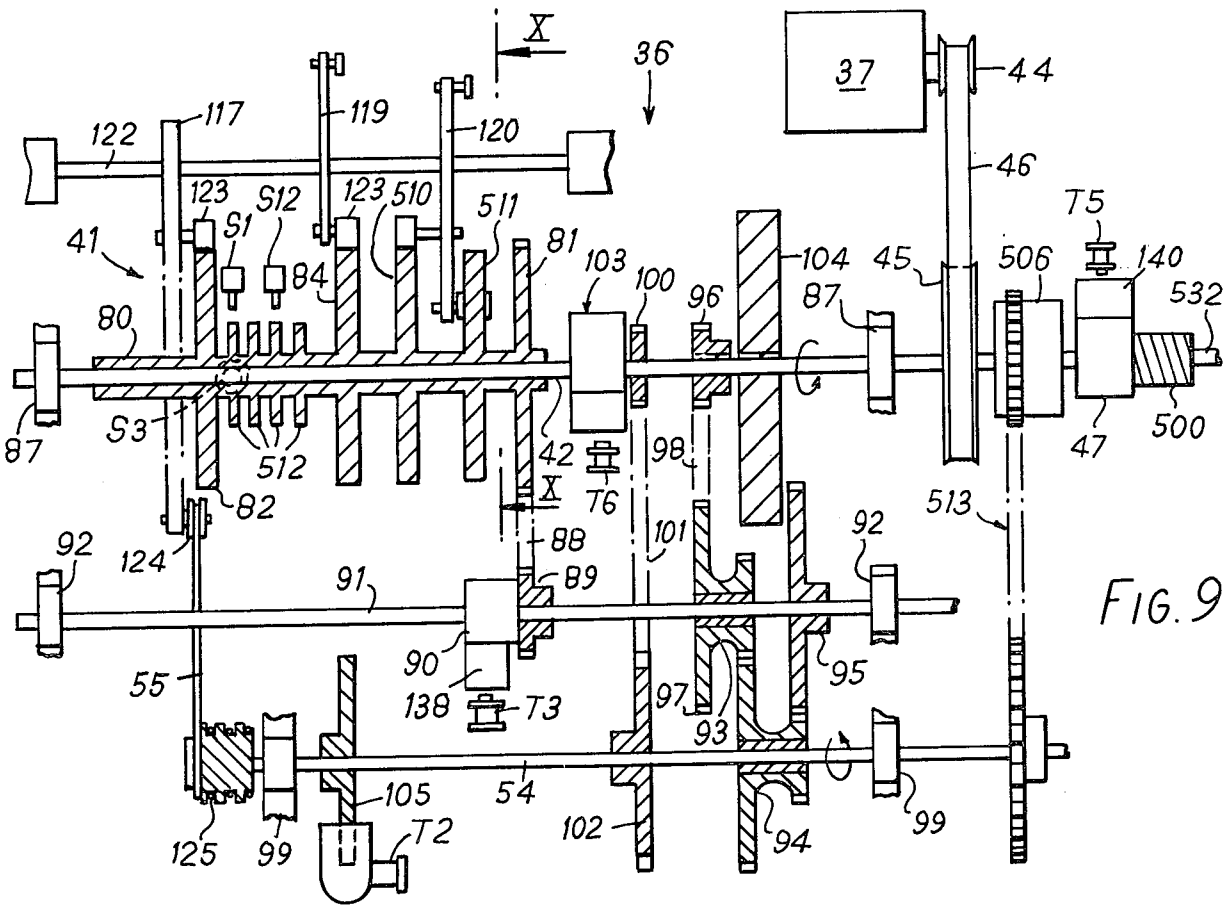
FIG. 9 is a simplified part sectional view of a main drive means for the apparatus.

Reverting to the raising and lowering of the table unit 24, the principal means for raising it comprises a winch 125 (FIG. 9) carried by a winch shaft 54 which is coupled through third mechanical coupling means in the form of a winch clutch 103 (FIG. 9) with the first drive shaft 42. This winch raises the table unit 24 by means of a lifting cable 55 when the winch clutch is engaged. When the winch clutch is disengaged, the table unit 24 can be lowered by gravity under control of means for exerting a reverse torque, comprising a brake 105 and a variable-torque clutch 506 (FIG. 9). Lowering of the table unit is normally obtained by means of a foot pedal controlling the brake 105.

The cam clutch 90 is arranged to be engaged and disengaged according to a sequence determined by the rotational position of rotatable elements arranged to be driven from the motor 37, so that the various pack-forming elements actuated in reponse to the actuating cams perform their functions according to the sequence. This is achieved in the present example by associating, with some of the said rotatable elements, feedback means in the form of a electrical circuit including solenoids which operate the clutches 90, 47 and 103, and microswitches operated by the said rotatable elements. To explain further, it is one or more of the actuating cams themselves which, as rotatable elements, operate microswitches to control the cam clutch solenoid and so start and stop the rotation of the cams. However, as will be more fully described hereinafter, the circuit also includes further microswitches, for example a pair of switches S7 and S8 (FIG. 5) operated by one of the sprockets 56, of the ejector drive 49; a limit switch S4 (FIG. 4) operated by the table unit 24 in the lowermost position of the latter; and a limit switch S9 (FIG. 4) operated by the table unit in its topmost position. One of the functions of the ejector microswitches S7 and S8 is to enable the cam clutch solenoid to be energised at a stage in the sequence of operation when the cams themselves are stationary. The limit switch S4 is so connected as to prevent the ejector operating except when the table unit is in its lowermost position. The function of limit switch S9 will be explained hereinafter.

While the machine just described with reference to FIGS. 4 and 5 is a variable-length pack apparatus (as herein-before defined), it will be understood that by the adoption of certain modifications it may equally well be a constant-length pack apparatus. In such a constant-length pack apparatus for forming packs from material taken from a reel such as the reel 26, the jaw sub-assembly 29 may be made movable down to a position close to the pack-supporting surface 25 for the purpose of picking up the free end 32 of the web 33. Since only two relative positions of the pack support surface 25 and jaw sub-assembly 29 are here required instead of the gradually-variable distance between them which is called for in a variable-length pack apparatus, a simple lever linkage controlled at all times by one of the cams may be employed to move the jaw sub-assembly up and down, or, in another alternative, to enable the table unit 24 to move up and down between the top position (as indicated by broken lines in FIG. 4), for presenting the free leading end 32 of the web to the jaw 30, and its normal or bottom position.

A more simplified version of a constant-length pack machine using a reel 26 may be provided by omitting the ejector 38 altogether and providing for removal of the completed pack upwardly through the top opening 34, either before or after the pack is cut from the remainder of the web 27. In the former case, if cutting means are incorporated in the machine, they will be provided over the top jaws 30, so that removal of the pack also draws new material upwards, to present its top end portion to the jaws 30 and 31. This effect may also be achieved if cutting means are not incorporated in the machine, the pack being for example cut or otherwise separated manually as proposed hereinbefore. It is also then unnecessary to make either the jaw sub-assembly or the table unit movable.

In constant-length pack apparatus in the forms above described, the arrangement including pedal and brake for gradually lowering the table unit is of course absent.

In another modified version of the machine described in FIGS. 4 and 5, to provide a constant-length pack apparatus using a plurality of preformed bags or lengths of wrapping material, or a block of continuous material as has hereinbefore been proposed, the magazine for containing the wrapping material may conveniently be arranged by the side of the loading chamber 23; neither the table unit 24 nor the jaw sub-assembly 29 is then movable up and down. In this instance the winch and winch clutch are absent, as well as the brake and pedal arrangement; and any suitable transfer device well known in the packaging machine art may be provided in the vicinity of the loading chamber for transferring each length of wrapping material in turn into a position in the loading chamber over the pack-support surface 25 so that the material may then the engaged by the jaws 30 and 31. An example of such a transfer device, which would be operated by one of the actuating cams of the main drive unit 36, is one which includes at least one movable vacuum arm for swinging or drawing the length of wrapping material into position.

It will be understood that, in constant-length pack apparatus according to the invention, for example as described above, there is no provision for the movement of the bottom gripping jaws or sealing jaws or any other component, such as would enable the length of the pack to be varied according to the amount of goods being wrapped. Such provision is made in the case of the variable-length pack machine shown in FIG. 4, viz.

the winch and winch clutch arrangement together with the pedal and brake above-mentioned.

GENERAL DESCRIPTION OF OPERATION

In this description the operation of the variable-length pack apparatus of FIGS. 4 and 5 will be explained in general terms, and it is convenient to treat the machine here as being intended for use at a supermarket checkout point, for wrapping goods selected by a customer. To this end a cash register (57, FIG. 4) may be placed on top of the cabinet 20, and the machine is operated by a cashier.

A complete cycle of operation consists of two distinct phases, viz. a loading phase and an operating phase. During the loading phase, the top shutter 35 is open and goods are loaded manually into the leading web portion 33 which is held open by the upper jaws 30. The cam clutch 90, ejector clutch 47 and winch clutch 103 are all disengaged; and the machine is inoperative, except that (*a*) the motor 37 will normally be left running, though not able to cause any pack-forming element of the machine to operate, and (*b*) the cashier can lower the table unit 24 from its initial or top position shown in broken lines in FIG. 4, in steps dependent on the amount of goods being loaded, by use of the pedal above-mentioned. Free downward movement of the table unit is controlled by the variable-torque clutch 506 and stopped only by the brake which is preferably released by depression of the pedal and engages automatically to stop the table unit when the cashier's foot is released from the pedal.

At the end of the loading phase, the cashier closes the shutter 35 and the machine then automatically performs the operating phase.

The sequence of operation in the operating phase is basically as follows, and it will be convenient to consider the sequence as a series of discrete steps, although in practice it will be understood that there may be some degree of simultaneity between one such step and another.

Step 1.

With the shutter 35 closed, Step 1 represents the initial condition of the machine, in which the upper jaws 30 and intermediate jaws 31 are open, the upper jaws holding the top end of the filled pack; the bottom jaws 259, 260 are also open; the knife 300 is inoperative; the feed rollers 272, 273 are stationary; the table unit itself is at a position dependent on the amount of goods that has been loaded into the web length 33; and all three of the clutches 90, 47 and 103 are disengaged.

Step 2.

The cam clutch 90 is engaged to rotate the actuating cams, one of which raises the table unit 24 slightly, to provide slack in the web length 33 at the top of the pack so as to enable it to be closed. The appropriate actuating cams then close the upper jaws 30 and the sealing jaws 31 simultaneously to close the top of the bag 10. The sealing jaws 31, as they close, form the handle 15 and upper weld seam 16 (FIG. 1) or 18 (FIG. 3). At the same time the lower jaws 259, 260 are closed so at to grip the bottom of the pack.

Step 3.

The knife 300 cuts the completed pack from the web 27, and also (in a manner to be described hereinafter) the bottom seam 11 is welded.

Step 4.

Further rotation of the appropriate actuating cams partly releases the upper jaws 30, and the sealing jaws 31, the latter serving if necessary to steady the top of the pack; and the lower jaws 259, 260 are opened.

Step 5.

The brake 105 is released so that, unless the table unit 24 is already in its bottom position indicated by full lines in FIG. 4, the table unit is now lowered to that position.

Step 6.

The ejector clutch 47 is engaged; the ejector 38 is moved forward to eject the pack, and then retracted clear of the loading chamber 23.

Step 7.

The winch clutch 103 is engaged, whereupon the motor 37 drives the winch 125 to raise the table unit 24 to its upper position. The lower jaws 259, 260 are still open, and have been since the end of Step 4; and the web 27 is carried forward (upward), as the table unit approaches the end of its travel, by the feed rollers 272, 273, in a manner to be described hereinafter, so as to present the leading end of the web 27 between the upper jaws 30. The winch clutch is disengaged, and the cam clutch engaged, by operation of the limit switch S9 when the table unit reaches its topmost position.

Step 8.

Upon further rotation of the actuating cams, the jaws 30 are momentarily closed to grip the web, and then the jaws 30 and 31 are opened fully, the upper jaws taking the side walls 12, 13 of the web outwards with them.

Step 9.

When the jaws 30, 31 are fully open, the cam clutch 90 and the ejector clutch 47 are disengaged and the shutter 35 can be opened for the next loading phase.

It will be noted that in Step 7 the cam clutch is engaged by operation of switch S9. This switch may be connected electrically in series with a film detector relay unit, mounted for example where indicated at 58 in FIG. 4, and arranged so as to give a warning, audible or visual, that the supply of film is nearly exhausted. At the same time the relay unit 58 can prevent the cam clutch 90 from being engaged. The operating cycle is then interrupted prior to Step 7 so that the empty reel 26 can be removed and a new reel fitted.

The above-mentioned and other features of the machine, in various embodiments, will now be described in greater detail.

MAIN DRIVE UNIT AND EJECTOR DRIVE

Referring to FIG. 9, the main drive unit shown therein the main cam means 41 comprises a single main camshaft 80, which in this example is rotatable on the first drive shaft 42 and has an integral drive sprocket 81 and the following actuating cams, viz. a table lift cam 82; an upper jaw actuating cam 84 for opening and closing the jaws 30 (FIG. 4); a pair of intermediate jaw actuating cams 510, 511 for opening and closing the sealing jaws 31 (FIG.4); and a group of cams 512 which operate microswitches such as S1, S3, S12, for energising various electrical components. The table motor 505 is controlled partly by the switch S12.

The first drive shaft 42 is journalled in bearings 87 in the main frame 21 of the machine, and has the pulley 45 fixed to it, whereby the shaft 42 is kept in continuous rotation by the motor 37.

The main cam unit 41 is driven through its sprocket 81, and a chain 88 engaging a further sprocket 89, from the driven side of the cam clutch 90. The latter is mounted (in this example) on a layshaft 91 fixed to the driving side of the cam clutch 90, the sprocket 89 being freely rotatable on the layshaft 91. The layshaft is journalled in bearings 92 in the main frame 21, and is driven through a gear train, consisting of wheels 93, 94, 95, from a sprocket 96 fixed to the first drive shaft 42 and driving a sprocket 97 of the wheel through a chain 98. The wheel 93 is freely-rotatable on the layshaft 91, the driven wheel 95 of the said gear train being fixed to the layshaft.

The intermediate wheel 94 of this gear train is freely rotatable on the winch shaft 54, which is journalled in bearings 99 of the main frame 21. The winch shaft is driven by a sprocket 100, freely-rotatable on the first drive shaft 42 and driving the winch shaft 54 through a chain 101 and a sprocket 102 fixed to the winch shaft. The sprocket 102 is fixed to the driven side of the winch clutch 103, the driving or input side of which is fixed to the first drive shaft 42.

The first drive shaft 42 carries a flywheel 104; and the brake 105 is shown here as an electrically-actuated disc brake 105 on the winch shaft 54, controlled by a brake solenoid T2 which applies the brake when energized. The winch shaft is coupled to the variable-torque clutch 506 on the shaft 42, for example by a chain drive 513.

The cam clutch 90 and winch clutch 103 are controlled by solenoids T3 and T6 respectively. Solenoid T3 is operated by two microswitches S1, S3, disposed for example in a common operating plane 90° apart from each other and operated by one of the cams 512.

The ejector clutch 47, which is controlled by a solenoid T5, has its driving side fixed to the shaft 42, and its driven side fixed to the worm 500. Referring to FIGS. 7 and 8, the ejector actuating mechanism comprises a primary crank 515 fixed to the driven sprocket 516 of the chain drive 49, and a secondary crank 517 fixed to a sprocket 518 which is freely rotatable on a pin 519 carried by the crank 515. A chain 520 couples sprocket 518 with a sprocket 521 fixed with respect to the main frame 21. The ratio of the diameter of sprocket 521 to that of sprocket 518 is 2 to 1. The crank 517 carries a drive pin 522 trapped between a bar 523, fixed on the ejector body 39 and a pair of spring loaded pawls 524 also carried by the ejector body. The pawls 524 provide a convenient means for releasing the ejector from the mechanism 502 manually when required. The 2:1 "folded-crank" arrangement of the mechanism 502 is such that one revolution of the driven sprocket 516 causes the pin 522 and therefore the ejector 38 to move in a straight line on a forward and then a backward stroke, as indicated by the arrows 525 in FIG. 5, the cranks 515, 517 moving from the "in-line" position shown in full lines in FIG. 5 through positions as shown in chain-dotted lines back to the "in-line" position. The switches S7 and S8 may be actuated by a cam 116 rotatable with the sprocket 56.

The actuating cams 82 and 84 operate cam followers 123 on cam levers 117, 119 respectively, pivoted on a common pivot bar 122 fixed to the main frame 21 of the machine. The table lift cam lever 117 carries at its outer end a pulley 124 over which the table unit lift cable 55 passes (see also FIG. 4). One end of this cable is secured to the table unit 42 and the other is wound on the winch 125, which is preferably of a kind such as to allow the cable 55 to be paid out from it and drawn on to it, along an axis intersecting the axis of rotation of the winch.

The table lift cam 82 is so profiled that, when rotated at Step 2, it causes lever 117 to raise the pulley 124, and so exert an upward pull on the cable 55 to raise the table unit slightly, the winch 125 being stationary so that a 2:1 velocity ratio is obtained. This is the sole function of this cam, the profile of which is such that at all other times the table lift cam lever 117 is held stationary.

The cams 510, 511 engage followers 530, 531 respectively, both of which are carried by a common lever 120 pivoted on the bar 122. The functions of the levers 119, 120 will be evident from the description of the jaw sub-assembly hereinafter.

Figure 13:
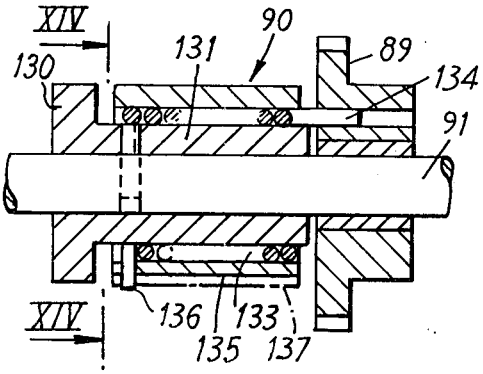
FIG. 13 is a view similar to FIG. 11, but taken on the line XIII—XIII in FIG. 14 and showing another clutch.
Figure 14:
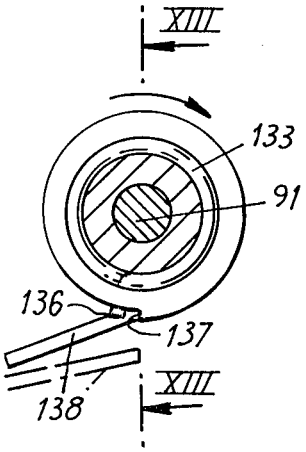
FIG. 14 is a sectional view taken on the line XIV—XIV in FIG. 13.

Each of the clutches 47, 90, 103 is of the torsion spring kind. FIGS. 13 and 14 show the cam clutch 90, and FIGS. 11 and 12 the winch clutch 103. To avoid undue repetition, the same reference numerals are used in FIGS. 13 and 14 as those in FIGS. 11 and 12, to denote parts having equivalent or similar functions.

Referring to FIGS. 13 and 14, the cam clutch 90 has a driving member 130 having a cylindrical sleeve portion or hub 131 fixed to the layshaft 91, and a driven member which includes the sprocket 89. These are relatively rotatable and, when the clutch 90 is engaged, sprocket 89 is connected to hub 131 by a torsion clutch spring 133 which is fixed by its projecting end 134 to sprocket 89. Spring 133 is in frictional engagement with the hub 131, around which the spring is wound. The spring 133 tends to wind itself on to the hub, requiring an applied force to unwind it. The clutch also includes an actuating sleeve 135 coaxial with hub 131 and encircling spring 133, the other end 136 of which is secured to sleeve 135. Slight rotation of sleeve 135 with respect to sprocket 89 in the appropriate direction unwinds spring 133 sufficiently to release it from frictional engagement with the hub 131, whilst relative rotation in the opposite direction permits the spring to wind up again to restore the said frictional engagement and so re-engaged the clutch. The actuating sleeve 135 has an external radial shoulder 137 for engagement with a trigger 138 movable by the cam clutch solenoid T3 between a "cam engaged" position, shown in broken lines in FIG. 14, when the solenoid T3 is energized, and a "cam disengaged" position, shown in full lines, when the solenoid is de-energized. In the latter position with the layshaft 91 rotating in the direction of the arrow in FIG. 14, when the shoulder 137 reaches the end face of the trigger 138, further rotation of the actuating sleeve 135 is halted and the spring 133 is unwound from the hub 131, which continues to rotate freely.

The ejector clutch 47 is similar to the cam clutch 90 except that the driven member is a suitable member secured to a driven shaft 532 carrying the worm 500 to which the driving member is not fixed; the driving member of the clutch is secured to shaft 42. Clutch 47 is actuated by a trigger 140 from the solenoid T5, being engaged when solenoid T5 is energised.

The above description of the clutches is much simplified as are FIGS. 11 to 14, since this general type of clutch is known per se and commercially available in various forms.

The third or winch clutch 103 is of a modified form. This is necessary because whereas in the case of the cam clutch 90 and ejector clutch 47 no movement of the driven member is called for when the clutch is disengaged, in the winch clutch the driven member, viz. the sprocket 100, must be able to rotate freely when the clutch is disengaged. Thus, during the loading phase and again during Step 5 of the operating phase, the winch 125 must be able to rotate as the table unit 42 is lowered under gravity.

Figure 10:
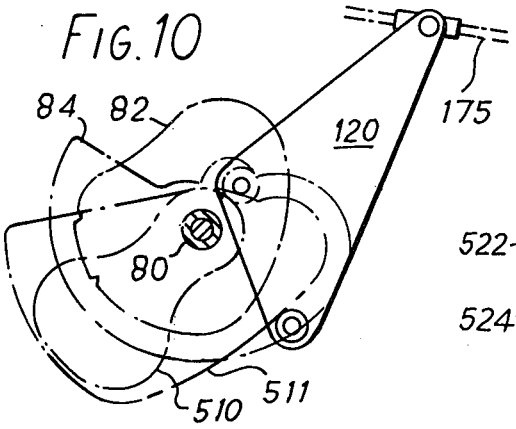
FIG. 10 is a diagrammatic view on the line X—X in FIG. 9.
Figure 11:
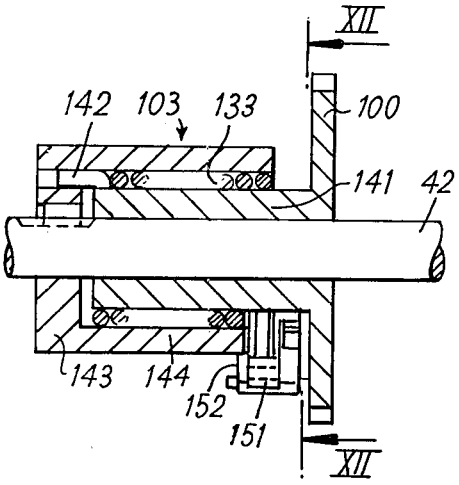
FIG. 11 is a diametral section, taken on the line XI—XI in FIG. 12, of a winch clutch forming part of the main drive means shown in FIG. 9.
Figure 12:
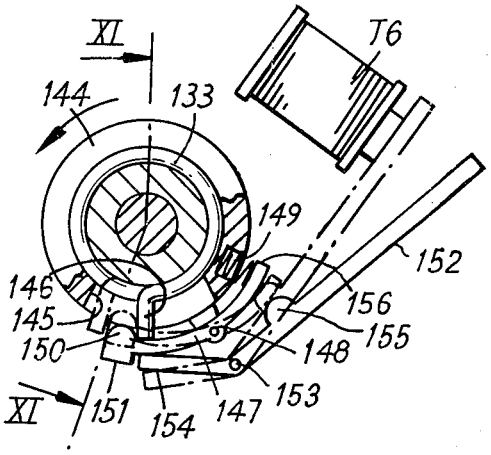
FIG. 12 is a sectional view taken on the line XII—XII in FIG. 11.

Referring to FIGS. 11 and 12, therefore, a concentric hub 141 is rotatable with the driven sprocket 100, and the spring 133 is fixed at one end 142 to the driving member 143, which includes a sleeve 144 encircling spring 133 and having a slot 145 in which the other end 146 of the spring is movable between its engaged position (shown in full lines in FIG. 12) and its disengaged or unwound position shown in dotted lines. The actuating member in this case is a latch 147, pivoted at 148 on the sleeve 144. One end 156 of latch 147 is biassed away from the sleeve by a compression spring 149, and its other end has a spring-engaging element 150 and a trigger-engaging element 151. The winch clutch solenoid T6 is associated with a trigger 152, pivoted at 153 and having a free end 154 for engagement with latch element 151 and a suitable portion 155 for engaging the latch end 156. The trigger 152 has two positions, viz. a "clutch engaged" position shown in dotted lines in FIG. 10, in which solenoid T6 is energised, and a "clutch disengaged" position shown in full lines, when the solenoid is de-energised.

When the clutch 103 is disengaged, with trigger 152 in the position shown in full lines its free end 154 lies clear of the latch element 151, which is held as shown in broken lines by the latch spring 149. In this position, the latch element 150 holds spring 133 unwound.

When at Step 7 of the operating phase it is required to engage the winch clutch 103, solenoid T6 is energised and trigger element 155 depresses latch 147 against spring 149, moving the latch to its position shown in full lines in FIG. 12. The spring end 146 by virtue of suitable profiling of the latch element 150, can now force the latter further onwards against the action of spring 149 as the spring 133 tends to wind itself on to hub 141. When the end 146 of spring 133 has reached its "engaged" position as shown in full lines, latch 147 returns to the position in which its end 156 engages the trigger element 155.

At the end of Step 7 of the operating phase, the solenoid T6 is de-energised, latch 147 is held by spring end 133 in the position where it already is relative to the sleeve 144. During the next revolution of the clutch, in the direction of the arrow in FIG. 12, the latch element 151 therefore meets the trigger end 154, which halts rotation of the driven side of the clutch. Because of the momentum given by the flywheel 104 (FIG. 9), however, driving member 143 continues to rotate until the spring 133 is unwound to its dotted position relative to the sleeve 144, over-riding the latch 147. The latch 147 then reverts to its fully-in (dotted) position as shwon in FIG. 10. In this position it cannot be over-ridden by the spring end 146 and, because the latch is clear of trigger 152, both the driving and driven members 143 and 100 can rotate independently on each other.

JAW SUB-ASSEMBLY

Figure 15:
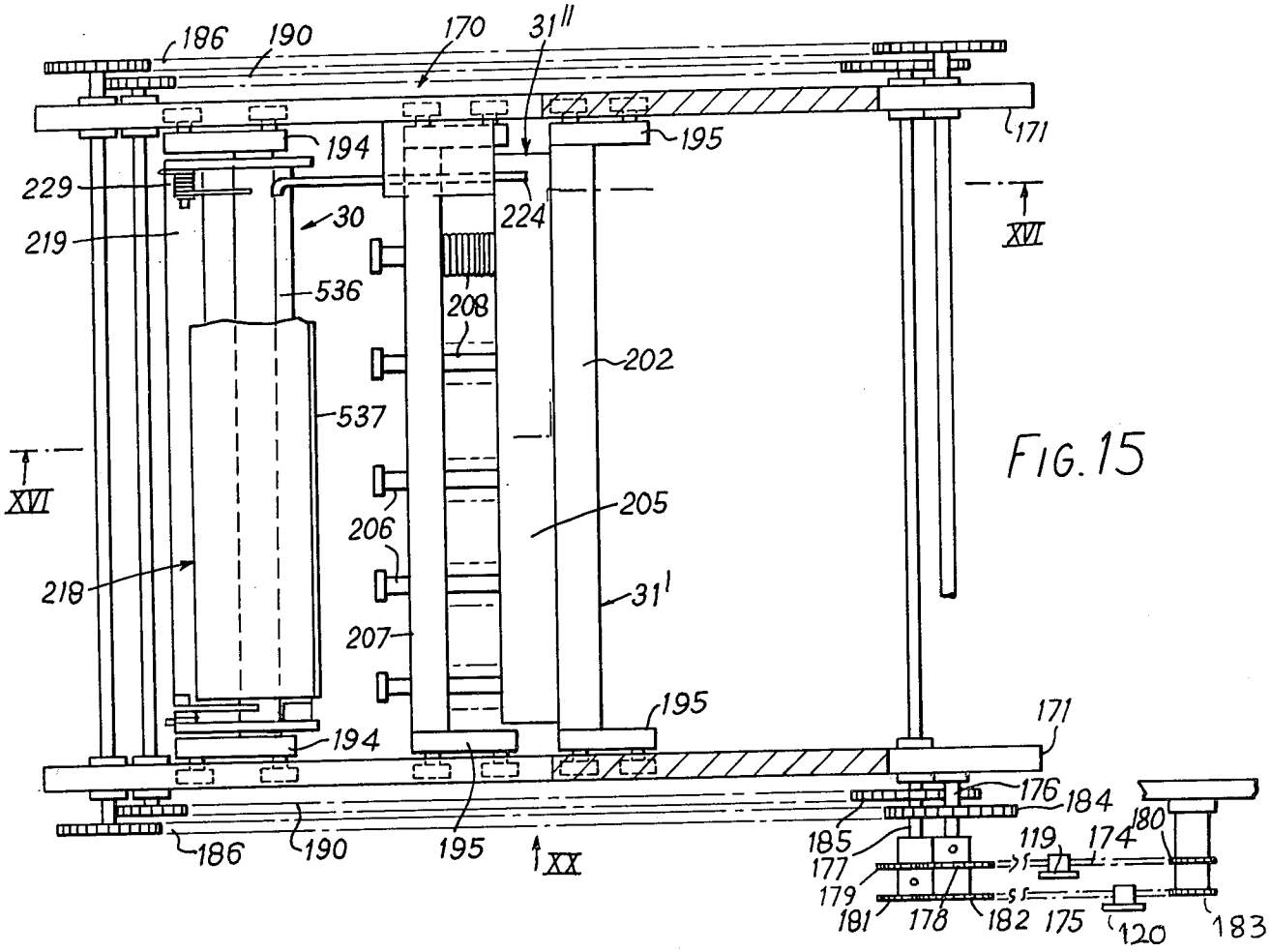
FIG. 15 is a simplified part-sectional plan view, taken on the line XV—XV in FIG. 16 and showing a subassembly of a preferred apparatus according to the invention, the sub-assembly including upper and intermediate web-engaging jaws.
Figure 16:
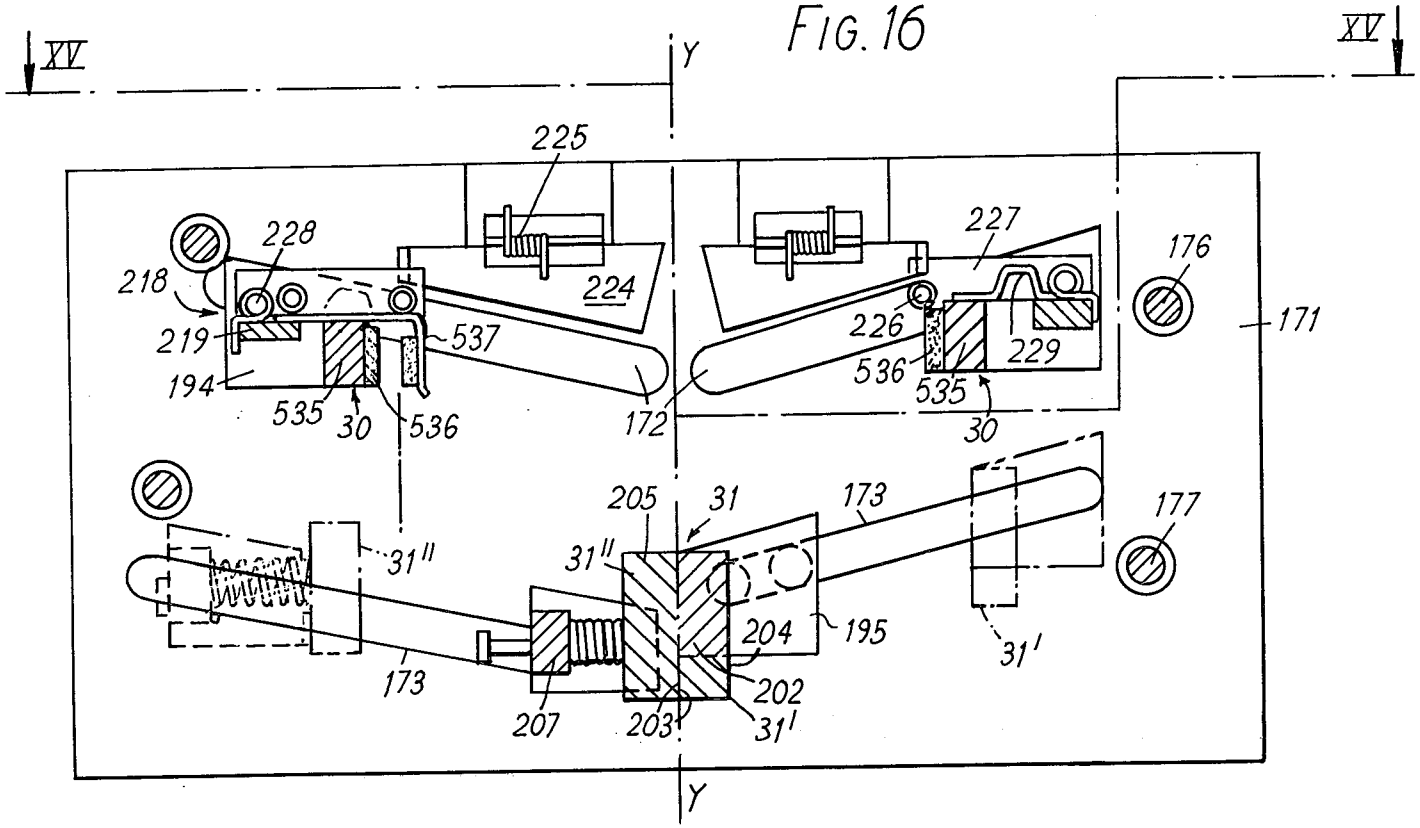
FIG. 16 is a sectional elevation of the same sub-assembly, taken on the line XVI—XVI in FIG. 15 and, like FIG. 15, showing for convenience the upper jaws in an almost fully-open position and the lower jaws in a fully-closed position.
Figure 17:
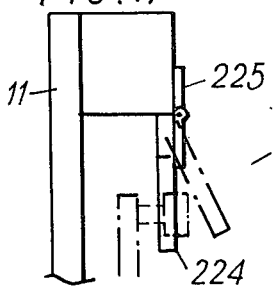
FIG. 17 is an end view of a gripper cam in the sub-assembly of FIGS. 15 and 16.

Referring now to FIGS. 15 to 23, the jaw sub-assembly 29 comprises a sub-frame 170, fixed to the main frame 21 and having parallel side plates 171 in the upper part of the loading chamber 23. The side plates 171 have jaw guide means in the form of two pairs of slots 172, 173, of which the pair of upper slots 172 are inclined upwardly as shown in FIG. 16, from the central transverse plane, indicated at Y-Y, in which the upper jaws 30 and the intermediate jaws 31 meet when fully closed.

Figure 23:
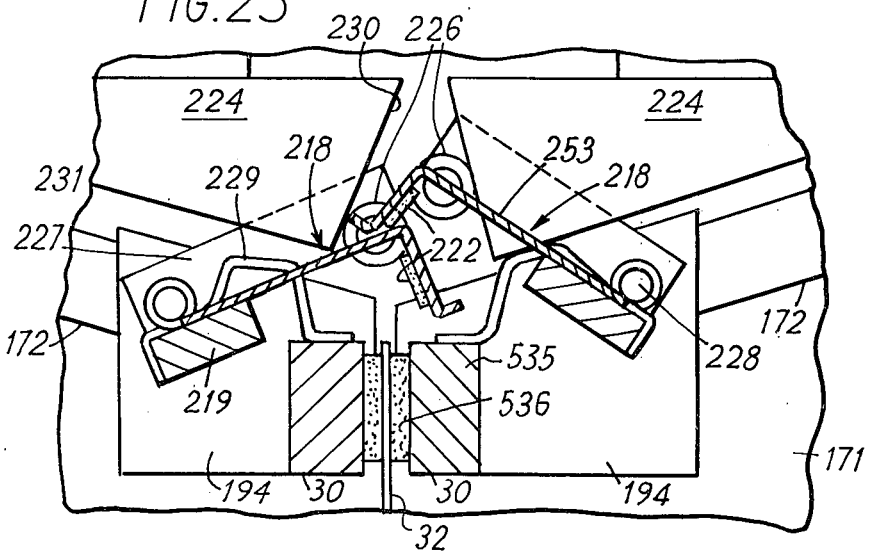
FIG. 23 is an enlarged sectional scrap elevation corresponding to part of FIG. 16 but showing the upper jaws in a fully-closed position.
Figure 20:
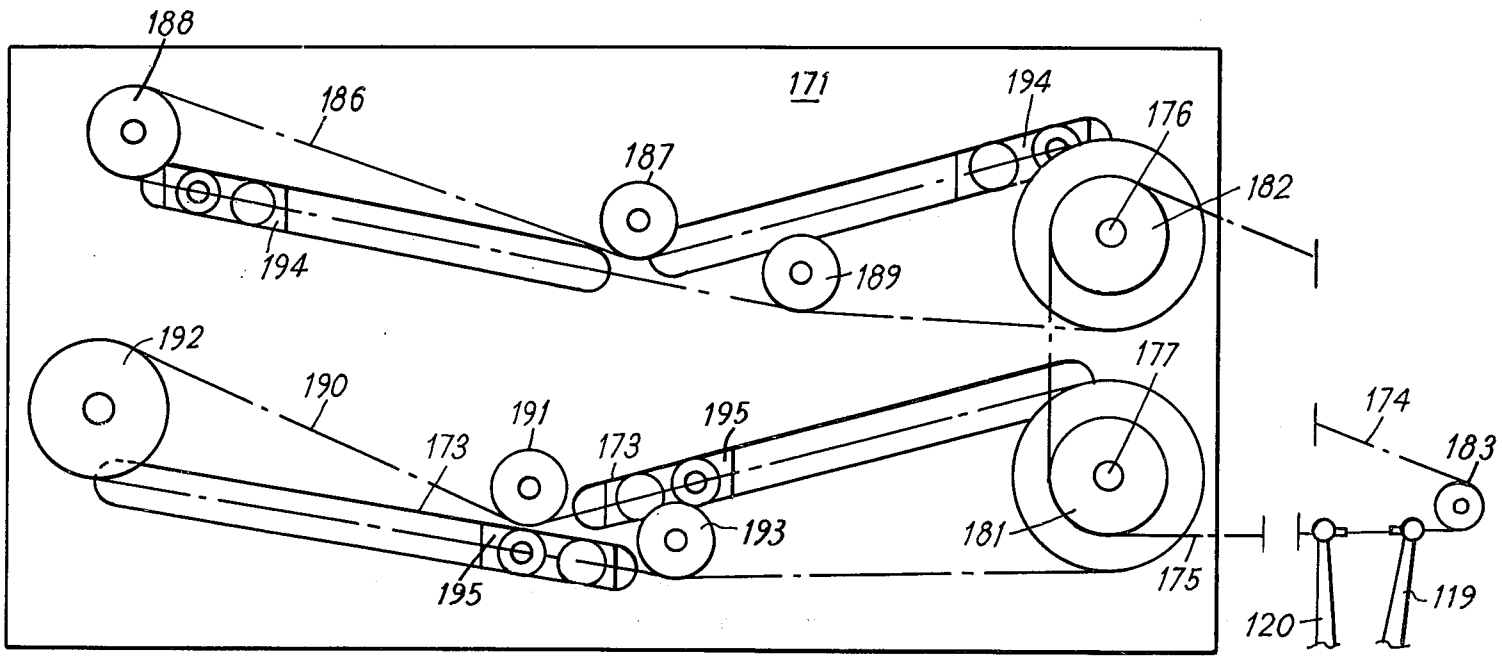
FIG. 20 is a simplified side elevation of the sub-assembly shown in FIGS. 15 to 17.

In FIGS. 15, 16 and 20, for clarity the sealing jaws 31 have been shown fully closed whilst the upper jaws 30 are shown nearly fully open. It will be appreciated that in practice, when the sealing jaws 31 are closed, the upper jaws 30 are also closed, as shown in FIG. 23; and when the sealing jaws are open, as indicated by chain-dotted lines in FIG. 16, the upper jaws 30 are in the region of their open position.

The jaw cam levers 119 and 120 (FIG. 9) are coupled at their free ends to respective chains 174, 175 which extend around sprockets to drive, respectively, an upper jaw drive shaft 176 and a sealing jaw drive shaft 177 rotatable in the side plates 171. Chain 174 engages a drive sprocket 178 fixed to shaft 176, an idler sprocket 179 freely rotatable on the shaft 179 and another idler sprocket 180; whilst chain 175 engages a drive sprocket 181 fixed to shaft 177, an idler sprocket 182 freely rotatable on shaft 176 and an idler sprocket 183 coaxial with sprocket 180. In this way the cams 84 and 510, being suitably profiled, can rotate the respective shafts 176 and 177, independently of each other but on a related sequence determined by the profiles of the cams 84 and 510.

The jaw drive shafts 176 and 177 carry respectively a main upper jaw sprocket 184 and main sealing jaw sprocket 185. An upper jaw drive chain 186 extends around sprocket 184 and around idler sprockets 187, 188 and 189 rotatably carried by the subframe 170. Similarly an intermediate jaw drive chain 190 extends around the sprocket 185 and idler sprockets 191, 192 and 193.

As will be seen from FIG. 20, the chain 186 is fixed to a pair of upper jaw carriers 194 whilst the chain 190 is similarly fixed to a pair of sealing jaw carriers 195, the arrangement being such that when either one of chains 186 or 190 is moved by the corresponding drive shaft 176 or 177, the corresponding pair of jaw carriers 194 or 195 are moved simultaneously either towards or away from each other, according to the direction of movement of the chain 186 or 190.

Each upper jaw 30 has a jaw carrier 194 at each end, movable along the slots 172 so that the slots guide the upper jaws when they open and close. Similarly each of the intermediate jaws 31 has two jaw carriers 195 movable along the slots 173.

Each jaw 30 or 31 basically comprises a transverse stock member extending between the two jaw carriers. In the upper jaws 30, this stock member is a rigid transverse jaw bar 535 fixed to the jaw carriers 194 and serving as a base member to which is attached a web-engaging strip 536. Each strip 536 is of a resilient material, rubbery or gelatinous, of a kind resistant to fungal attack and capable of adhering to the material 32 whilst allowing the latter to be peeled readily away when the jaws are opened.

Similarly, one of the sealing jaws indicated at 31', comprises a simple rigid transverse jaw bar 202 fixed to the jaw carriers 195 and having a transverse web-engaging face 203. The jaw bar 202 carries a sealing bar 204 which includes an electric heating element and which is of a known kind for forming the upper weld seam 16 (FIG. 1) or 18 (FIG. 3) of each pack. The other sealing jaw 31'', has its web-engaging face 203 disposed on a jaw bar 205 from which rods 206 project backwardly and are slidable in holes in a rigid stock member 207, the jaw bar 205 being biassed towards the jaw 31′ by compression springs 208. The stock member 207 is fixed to the jaw carriers 195 of jaw 31″. Thus when the sealing jaws 31′, 31″ are closed (FIGS. 15 and 16), springs 208 exert a lateral force between the web-engaging faces 203 of the jaws 31″, 31′.

If desired, the resilient mounting arrangement of jaw 31″ may be dispensed with, this jaw then being generally the same as jaw 31′.

The sealing jaws 31′ and 31″ have co-operating handle-forming means comprising a punch 209 projecting from face 203 of jaw 31′ (FIGS. 21 and 22) and a slot 210 in the face 203 of jaw 31″. The punch 209 and slot 210 have the form of the slits 15 (FIG. 1).

Associated with each upper jaw 30 is a clamping device 218, comprising a stock member 219 pivoted to the jaw carriers 194, for movement with respect to the corresponding jaw 30, and carrying a resilient clamping plate 537 which carries a resilient pad 222, so directed that with the clamping device closed as in FIG. 23, the clamping surface with its pad 222 will clamp the web end portion against the jaw strip 536.

Each clamping device 218 is movable pivotally by a respective clamp-actuating cam plate 224 between its first or open position relative to the associated jaw, as shown in FIG. 23, and its second or closed position shown in FIG. 16. Each cam plate 224 is hinged at its top edge (FIGS. 16 to 18) to the subframe 170, for movement between a first or swung-out position shown in chain-dotted lines in FIGS. 17 and 19, and a second or normal position shown in full lines. A light spring 225 biasses the cam plate 224 towards its normal position. The clamp stock member 219 carries a cam plate follower roller 226 on an arm 227 extending from member 219; and around the pivot 228 of the clamping device there is arranged a coil spring 229 bearing on the jaw bar 196 to bias the clamping device towards the open position shown in FIGS. 23.

Each cam plate 224 has an angled front or first camming surface 230 at its end nearest the plane Y-Y; and a straight lower or second camming surface 231 extending parallel with the direction of movement of the upper jaw. The surface 231 joins the surface 230 to a bevelled vertical rear camming surface 232.

Figure 18:
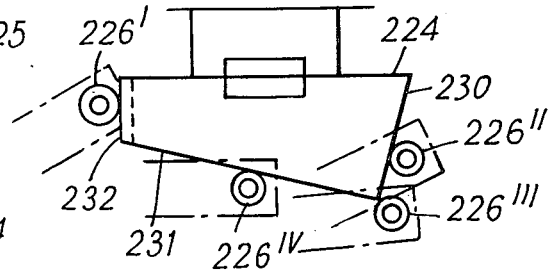
FIG. 18 is a simplified side view of the same gripper cam.
Figure 19:
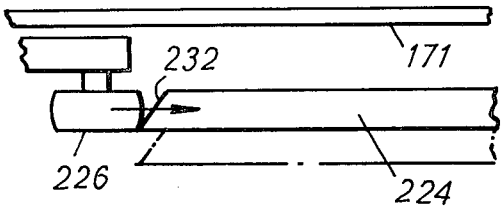
FIG. 19 is a simplified plan view of the same gripper cam.
Figure 21:
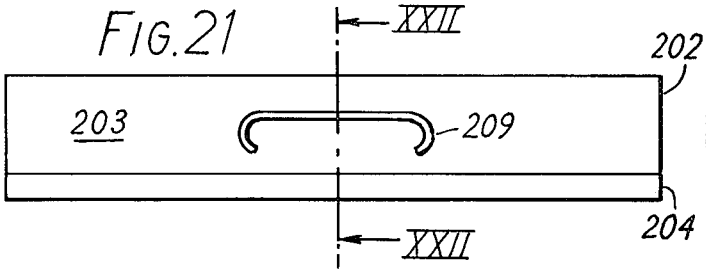
FIG. 21 is an elevation showing a web-engaging face of one of the intermediate jaws.
Figure 22:
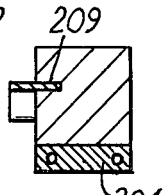
FIG. 22 is a transverse section taken on the line XXII—XXII in FIG. 21.

The operation of the cam plates 224 is as follows: When the upper jaws 30 are fully open, the roller 226 of each clamping device lies beyond the associated cam plate in the position indicated at 226′ in FIG. 18, the spring 229 holding the clamp in its raised or open position. When the upper jaws begin to close during Step 2 of the operating phase, roller 226 engages cam plate surface 232 and, as the jaws move down to close (see the left-hand arrow in FIG. 19), the roller 226 swings cam plate 224 out as shown in chain-dotted lines, against the spring 225. Roller 226 can now move past the cam plate and the clamp remains raised as the jaws close up to the position shown in FIG. 23. Roller 226 now lies beyond the cam plate surface 230 so that spring 225 can return the cam plate to its normal position. Thus with the jaws 30 fully closed, the periphery of roller 226 engages the face 230 (as at 226″ in FIG. 18). Referring to FIGS. 23 and 18, when during Step 4 the upper jaws are partly opened, roller 226 rides down surface 230 but not far enough to bring it into engagement with the surface 231; in this way the clamping device is closed partly against spring 229, but not far enough to clamp the top of the finished bag against the jaw strips 536. Thus at this stage the pack can be lowered freely away from the upper jaws, peeling away from the strips 536 in the process. The position of roller 226 at this stage is indicated at 226″ in FIG. 18.

During Step 7, when the leading end of a new length of web material is fed upwards between the upper jaws 30, the clamping device 218 is still in this slightly-open position. When the Step 9 the upper jaws begin to move to their fully-open position, separating the side walls 12, 13 of the web from each other, rollers 226 ride down to engage the cam plate surfaces 231 and the plates 537 move down between the web side walls 12, 13 to adhere the latter against the strips 536. As the jaws 30 move outwards, the plates 537 are held in this position by the rollers 226 running along the cam plate faces 231 ($226^{IV}$, FIG. 18). When the jaws are fully open, the roller rides beyond the cam position $226^{I}$ and the clamping device 218 is released, the web then being held against the upper jaws by strips 536 only.

The operation of the upper jaws themselves has largely been described above. As can be seen from FIG. 23, when fully closed at Step 2, the upper jaws 30 trap the end web portion 32 in a flattened condition between them. At the same time the sealing jaws 31 are fully closed, to form the upper weld seam and handle. As the sealing jaws 31 approach their closed position, the cam 511 moves the lever 120 in such a way as to apply a positive thrust across the web between the two jaws 31, thus applying an additional sealing pressure.

An alternative to the use of the resilient strips 536 is to make the upper jaws such as to hold the web by an applied vacuum in known manner.

If there is no need for sealing the upper part of the pack, or for forming a handle, the sealing jaws can be omitted, together with their cams 510, 511 and associated drive means. Alternatively, the upper jaws and intermediate jaws may be combined in a single pair of jaws in a manner which will be evident to those skilled in the art.

TABLE UNIT

Figure 6:
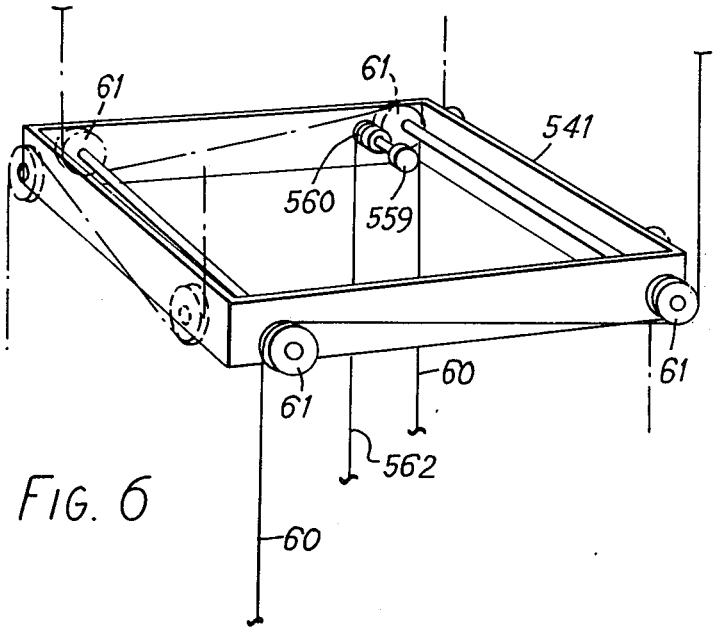
FIG. 6 is a diagrammatic general view showing a table unit and illustrating how it is mounted for vertical movement.
Figure 24:
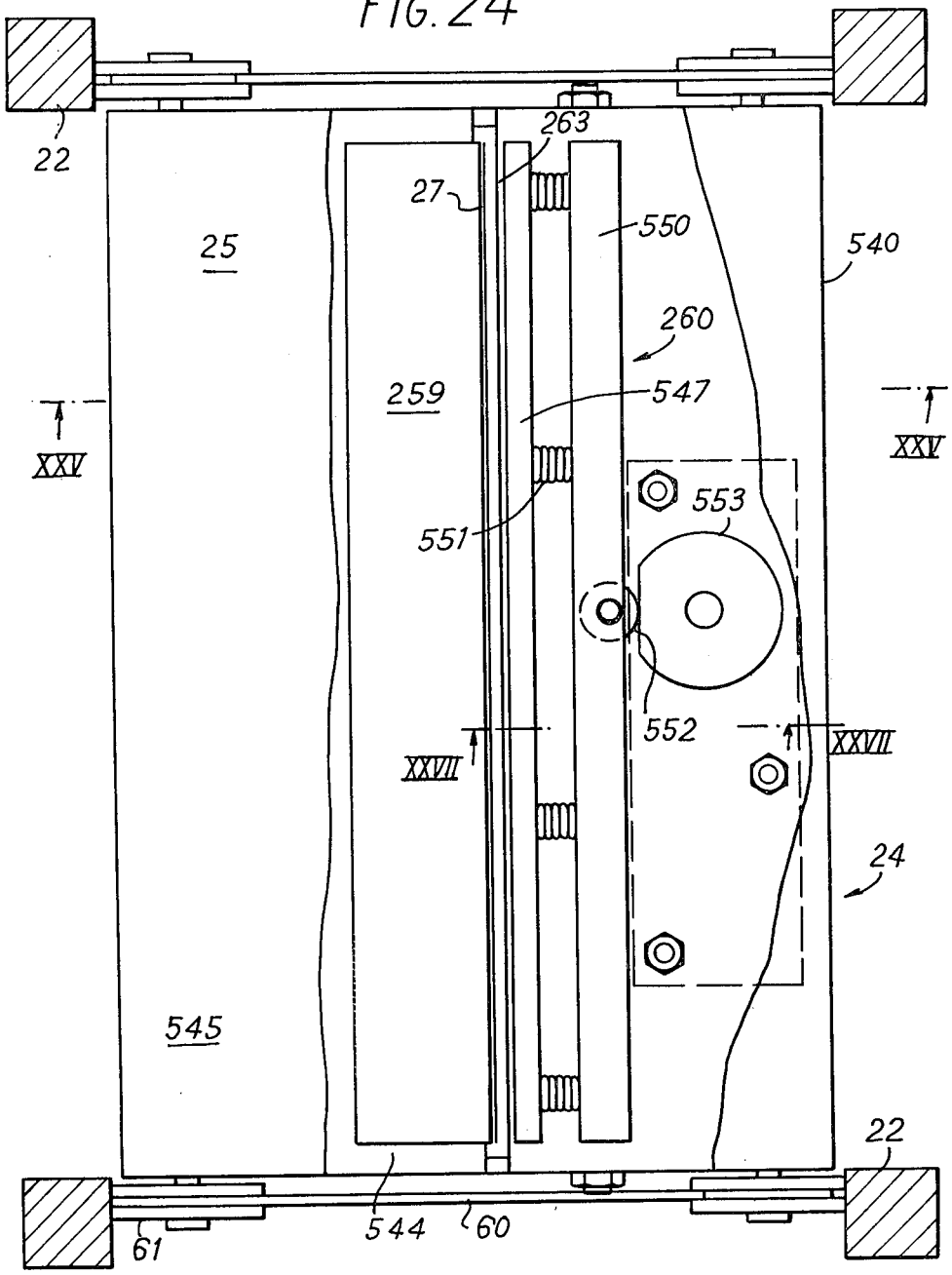
FIG. 24 is a plan view, partly cut away, of the table unit.

Referring to FIGS. 4 to 6, the table unit 24 comprises a table 540 supported in a cradle 541 which is carried by two fixed wire cables 60, arranged in tension and generally vertically. Adjacent each corner of the cradle there is a free-rotatable pulley 61, there being two pulleys 61 on each of two opposite sides of the table unit. A similar arrangement may be provided on the other two sides as well, if desired, as indicated by chain-dotted lines in FIG. 5. Each cable 60 extends over one of the pulleys and under the other pulley on the same side of the cradle. The vertical runs of the cables 60 are close to the main frame pillars 22, so that the pulleys 61 are in rolling contact with the adjacent pillars as shown in FIG. 24.

Vertical movement of table unit 24 under the control of cable 55 (FIG. 4) causes the pulleys to rotate whilst the cables 60 hold the table unit in a constantly horizontal attitude.

Figure 25:
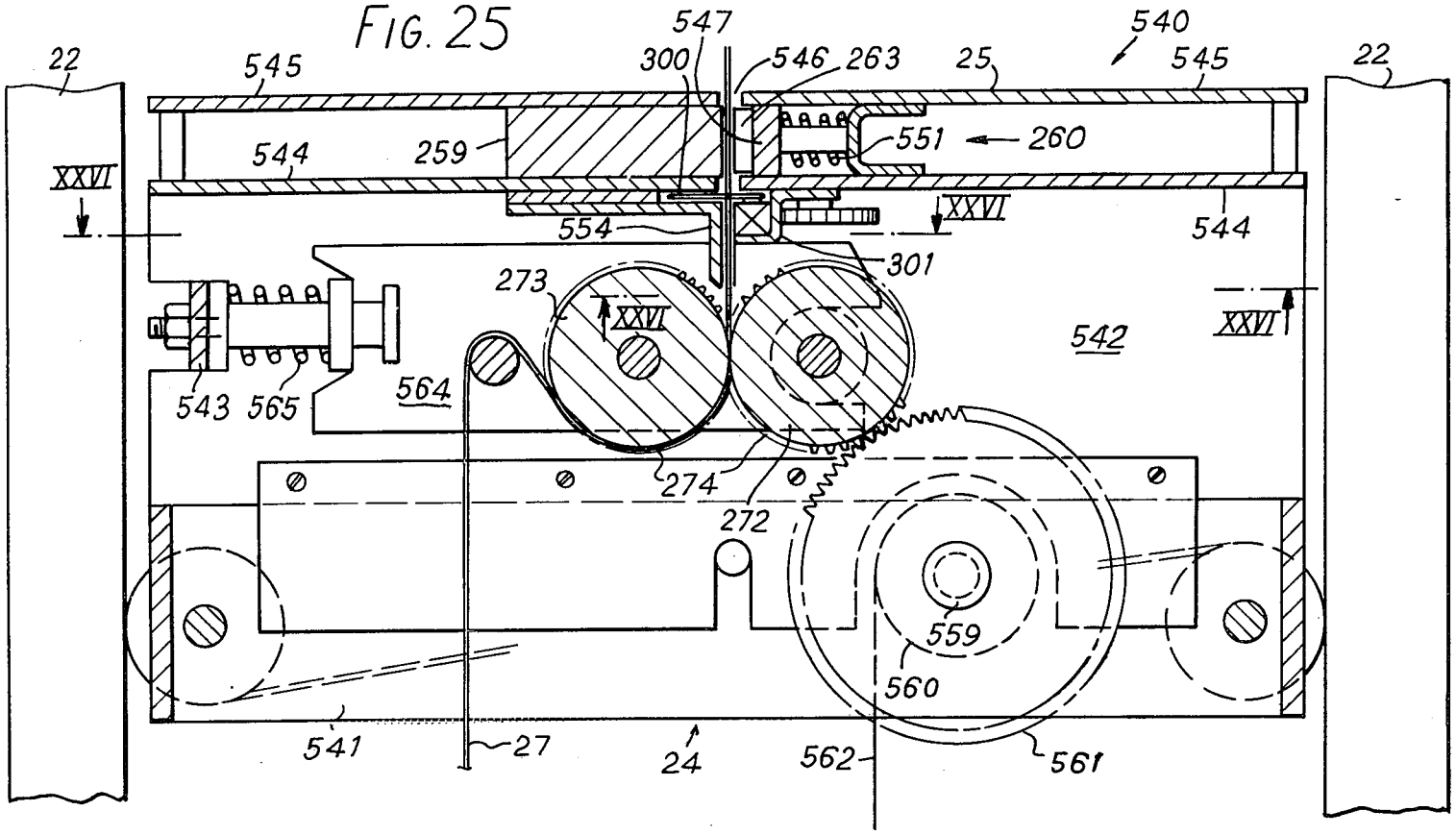
FIG. 25 is a sectional elevation on the line XXV—XXV in FIG. 24.

Referring now to FIGS. 25 to 29, the table 540 itself rests on the cradle as best seen in FIG. 25 and may be releasably secured thereto by means not shown. The table has a pair of side plates 542 joined by a stretcher 543 at one or each end and surmounted by a pair of co-planar plates 544 separated by a transverse slot; above and parallel to the plates 544, a pair of co-planar top plates 545, separated by a transverse slot 546 and defining the top surface 25, are supported on pillars. The fixed lower jar 259 is mounted between one plate 544 and one plate 545, whilst the movable lower jaw 260 is arranged between the other two plates 544, 545. The jaw 260 comprises a jaw bar 547 carrying an electric heating bar 263 and mounted on a rear bar 550 by means of rods 549 extending through holes in the rear bar 550, jaw bar 547 being biassed away from rear bar 550 by springs 551. Rear bar 550 carries a cam follower element 552 engaged by a lower jaw cam 553 such that rotation of the cam moves the jaw 508 into and out of gripping co-operation with the fixed jaw 259. The heating bar 263 may be incorporated in the fixed jaw 259 or moving jaw 260 or both.

The heating elements of the bars 204 (FIG. 16) and 263 are electrically connected in series or parallel with each other and controlled by a switch such as a suitably situated microswitch, not shown in the drawings.

Below the plates 544 there is fixed a web guide 554 to guide the web 27 up through the slots between the plates 544. Associated with the guide 554 is a knife chain track 555. The knife 300 is carried by an endless knife chain 301 running in the track 555 and passing round idler sprockets 557 and a drive sprocket 302. The cradle 541 carries a stub shaft 559 on which a hub 560 is rotatable. Coupled with hub 560 through a roller ratchet (not shown) is a drive gear 561. A cable 562 is fixed at its lower end to the main frame 21 and its other end is wound on the hub 560. A torsion spring 563 biasses the hub 560 in a direction of rotation such as to wind up the cable 562 on the hub. The said ratchet is arranged so that gear 561 rotates with hub 560 when the latter is rotating in an unwinding direction but not when it is winding the cable up. Gear 561 engages a gear ring 274 carried by the feed roller 272, this gear ring engaging an equal gear ring 274 of the other feed roller 273.

Figure 26:
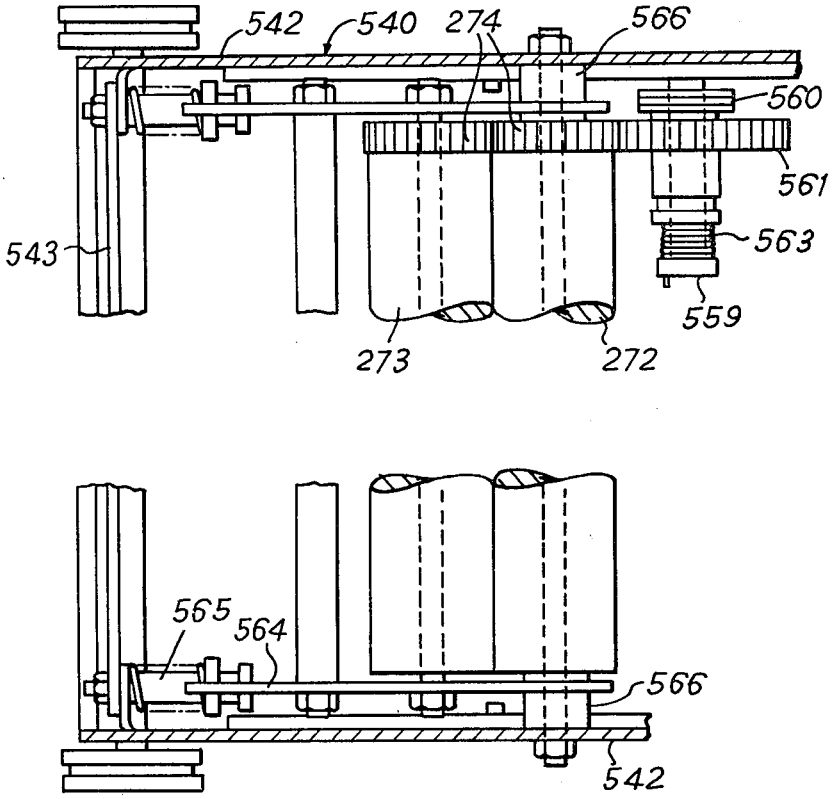
FIG. 26 is a plan view on the line XXVI—XXVI in FIG. 25.
Figure 27:
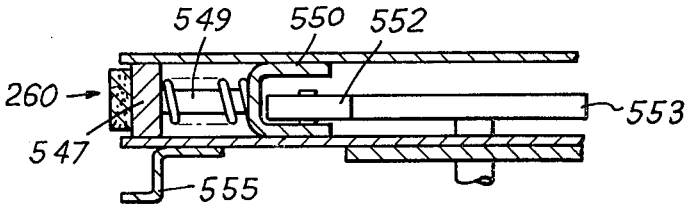
FIG. 27 is a view on the line XXVII—XXVII in FIG. 24.

As seen in FIG. 26, roller 272 is rotatable on a shaft fixed to the side plates 542, whereas roller 273 is rotatable on a shaft fixed to the parallel side plates of a subframe 564. The latter is resiliently mounted by fittings 565 to the table frame, to urge roller 273 towards contact with roller 272. The subframe 564 is supported by these mountings and by bushes 566 on the fixed shaft of roller 273.

The auxiliary motor 505 drives, through a reduction gear train 567, a shaft 568 which carries a sprocket 302. A further reduction gear 569 drives the shaft 570 carrying the jaw cam 553 and two further cams 571, 572 arranged to operate respective microswitches S10, S11 which are connected in parallel with switch S12 (FIG. 9) and in series with motor 505, thus providing three alternative sources of supply to the motor.

The cable 562 is so arranged that it is slack, with hub 560 fully wound up, except when the table unit is at or near the top of the loading chamber 23. In operation, at Step 1 of the operating phase the motor 505 and rollers 272, 273 are stationary. In Step 2, switch S12 is closed by its cam 512 to start motor 505. This rotates cam 553 to close jaw 260 against jaw 259 so as to grip the web 27 at the bottom of the pack, at the same time moving knife 300 from its rest position (300', FIG. 28) towards the position indicated at 300 in FIG. 28 at which it starts cutting the web. Cam 572 closes switch S11 and switch S12 is opened. The motor continues running in Step 3, so that the knife cuts the pack from the web 27 until cam 572 opens switch S11 to stop the motor when the knife is at the end of its cut, at position 300''. At this point one of the cams 512 first closes a switch, not shown, to energise the heater bar 263 and form the bottom seam 11 of the pack and then opens the same switch.

At step 4, switch S12 is reclosed by its cam 512, so that motor 505 starts again. Cam 571 closes switch S10, and switch S12 is opened. Knife 300 returns to its rest position at 300', and cam 553 rotates to separate jaw 260 from jaw 259 and so release the web. Cam 571 opens switch S10 to stop the motor 505 at exactly the point where the knife reaches its rest position.

In Step 7, as the table unit is raised the cable 562 becomes taut as the table unit approaches the top of its travel, causing the hub 560 to unwind the cable against spring 563. This rotation of the hub rotates the feed rollers 272, 273, so as to feed the leading end of the web 27 up through the slot 546 by an amount sufficient for the leading end of the web to come between the upper jaws 30 as the table unit reaches the top of its travel. During the subsequent loading phase as the table unit is gradually lowered, the hub 560 winds up the cable until spring 563 is relaxed, the feed rollers being stationary.

MISCELLANEOUS FEATURES

Figure 30:
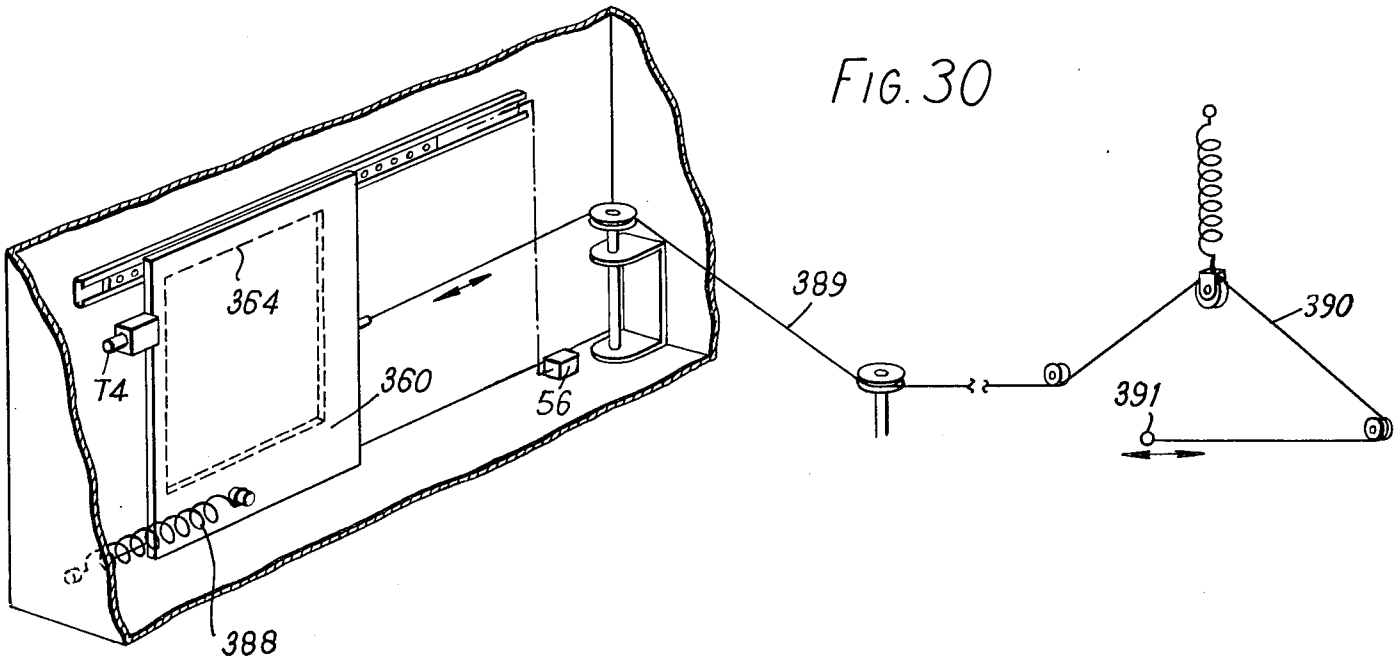
FIG. 30 is a somewhat diagrammatic cut-away general view showing an exit door for co-operating with the ejector.

Referring now to FIG. 30, an exit door 360 may be provided at the exit 364 (FIG. 5) of the cabinet. Door 360 has in a typical embodiment a return spring 388 and is carried by conventional sliding runners 389. A door lock solenoid T4 is shown in FIG. 30 in a position to engage the door and lock it shut and a limit switch 56 is operated by the door when the latter is fully open.

The door 360 is opened when the ejector 38 operates at Step 6 of the operating phase, and to be closed thereafter. It may therefore be coupled with the ejector so that the latter itself opens and closes the door on its forward and backward strokes respectively, for example by a cable 390, attached to the door 360 at one end and having at its other end an end member in the form of a ball 391, releasably engaged in a clip 392 carried by the ejector body 39 (FIG. 5).

If the supply of material on the reel 26 is exhausted this will be detected at the end of Step 7 by a film detector relay 58, FIG. 4, which operates to prevent the main cam unit 41 from operating until a new supply of web 27 extends past the relay. The empty reel 26 is therefore removed and a new one fitted. To save wastage of material, the relay 58 may be mounted in the table unit as close as possible to but below, the feed rollers. The relay 58 is preferably of a kind having wiper contacts energized by a foil marker on the end of the web, the relay being reset manually.

ELECTRICAL CONTROL SYSTEM

Figure 31:
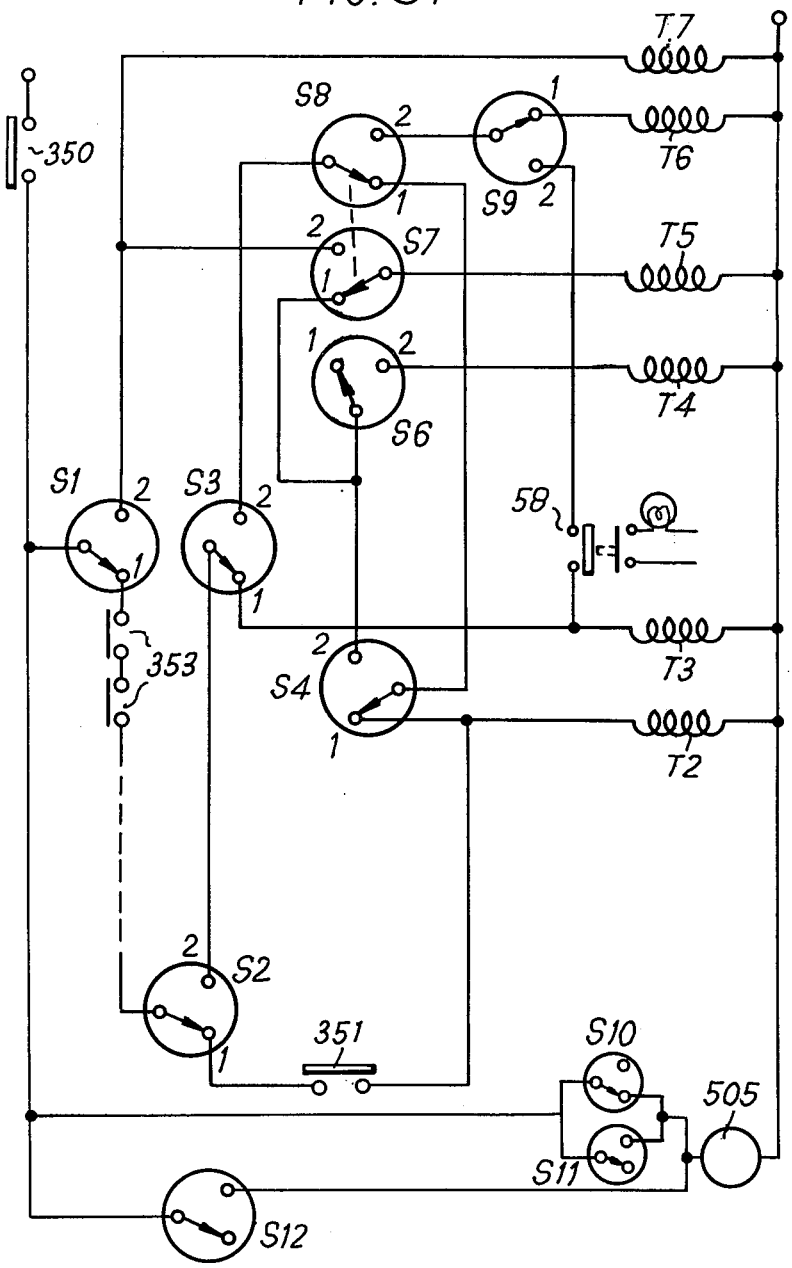
FIG. 31 is a simplified circuit diagram of the electrical control circuit of the apparatus.

The circuit shown in FIG. 31 is much simplified and is merely an example to help explain how the invention may be put into practice.

As shown in FIG. 31, the circuit comprises a main circuit breaker 350 supplying power to six solenoids T2 to T7 through various switches. The electrical connections to the main motor 37 and the heating elements are not shown. The microswitches S1 to S4 and S7 to S9 have already been mentioned in the foregoing description; similarly, the locations and functions of the solenoids T2, T3, T5 and T6 have been explained.

The film detector relay 58 is indicated in FIG. 31, as are a switch 351 operated by the foot pedal aforementioned, for lowering the table unit 24 during the loading phase, and safety switches 353, of which there may be any desired number arranged wherever required in known manner. Also shown in FIG. 31 are the door solenoid T4 and the door switch S6, which has two positions (1 and 2), being movable to position 2 only when the door is fully open. Similarly the shutter 35, FIG. 4, may be associated with a shutter locking solenoid T7, which is arranged to lock the shutter closed when de-energised and a switch S2 which is operated by opening and closing the shutter 35.

The operation of the control system is best explained in the form of the table below, in which the loading phase and the various steps of the operating phase described above in "GENERAL DESCRIPTION OF OPERATION" are related to eleven stages in the operation of the control system, each of these eleven stages being defined by operation of at least one microswitch. The FIGS. 1 and 2 in the columns headed "microswitch contacts closed" refer to the respective contacts 1 and 2 of the microswitches, all of which are represented as single-pole changeover switches; while the columm "solenoids energised" shows which solenoid or solenoids are energised as a result of the switching actions detailed at the corresponding stage of the cycle.

It will be notices that the stage of switches S4 and S9 at stage 2, i.e., at Step 1 of the operating phase, depends on whether the table unit is at its topmost position (for minimum pack length), or at its lowest position (for maximum pack length) or at an intermediate position between these extremes.

cluding holding means in said loading chamber for holding open a second end of each successive length of said wrapping material for goods to be loaded therethrough; the improvement comprising mechanical main drive means including cam means rotatable as a unit; a releasable first clutch coupling said cam means with said power unit; and feed-back means located engageably with respect to, and operable by, said cam means to engage and disengage said first clutch according to the rotational position of said cam means, said electrical control means including first switching means located engageably with respect to, and operable by, said cam means, and means connecting said first switching means electrically in series relationship with each of said electrical control means, whereby actuation of each pack-forming element takes place in a sequence each step of which is dependent at least on the rotational position of the cam means.

2. Apparatus according to claim 1, wherein said holding means comprises at least one pair of opposed jaws; means defining a substantially vertical web-engaging face of each jaw, extending the full width of said loading chamber and facing the web-engaging face of the other jaw of the same pair; jaw actuating means coupled with said cam means and with both jaws of said pair for simultaneous opposed movement of said jaws between an open position, for holding open an end web portion extending from said second end of a said length

| STAGE | | MICROSWITCH CONTACTS CLOSED S1 | S2 | S3 | S4 | S6 | S7 | S8 | S9 | SOLENOIDS ENERGIZED | CORRESPONDING STEPS OF OPERATING PHASE |
|---|---|---|---|---|---|---|---|---|---|---|---|
| 1 | Loading phase-lengthen bag | 1 | 1 | 1 | 1 | 1 | 1 | 1 | (2)1 | T2 | — |
| 2 | Start of operating phase: shutter closed- (minimum length of pack | 1 | 2 | 1 | 1 | 1 | 1 | 1 | (2)1 | T3 | 1,2,3,4 |
| | (intermediate length of pack) | 1 | 2 | 1 | 1 | 1 | 1 | 1 | 1 | T3 | |
| | (maximum length of pack) | 1 | 2 | 1 | 2 | 1 | 1 | 1 | 1 | T3 | |
| 3 | Pack just sealed and cut off | 1 | 2 | 2 | 1 | 1 | 1 | 1 | 1 | T2 | 5 |
| 4 | Start to run ejector | 1 | 2 | 2 | 2 | 1 | 1 | 1 | 1 | T5 | |
| 5 | Ejector fully extended | 1 | 2 | 2 | 2 | 2 | 1 | 1 | 1 | T4 T5 | 6 |
| 6 | Ejector retracted after ejection | 1 | 2 | 2 | 2 | 1 | 2 | 2 | 1 | T6 | |
| 7 | Raising table unit | 1 | 2 | 2 | 1 | 1 | 2 | 2 | 1 | T6 | 7 |
| 8 | Table unit at highest position | 1 | 2 | 2 | 1 | 1 | 2 | 2 | 2 | T3 | |
| 9 | Gripping and opening bag | 1 | 2 | 1 | 1 | 1 | 2 | 2 | 2 | T3 | 8 |
| 10 | Bag open and held by upper jaws; shutter unlocked | 2 | 2 | 1 | 1 | 1 | 1 | 2 | 2 | T7 | |
| 11 | Main cams stop; shutter opened | 1 | 1 | 1 | 1 | 1 | 1 | 1 | 2 | — | 9 |

I claim:

1. In packaging apparatus for forming successive packs of goods in flexible tubular wrapping material, said apparatus comprising: a power unit; pack-forming elements for handling said material in forming said packs; means defining a loading chamber of the apparatus; electrical control means for said pack-forming elements; pack support means in said loading chamber for supporting a succession of lengths of said material at a first end thereof, said packforming elements inof tubular material, and a closed position in which said end web portion can be trapped in a flattened condition between the pair of jaws; resilient clamping means pivoted on each said jaw about an axis transverse of said loading chamber; and clamp-actuating means mounted in the loading chamber adjacent the jaws, said clamp actuating means engaging said clamping means responsive to said opposed movement of the jaws for moving said clamping means with respect to the associated jaw before a first position clear of the jaw and a second position for clamping part of said end web portion substantially vertically against the corresponding said web-engaging face.

3. Apparatus according to claim 2, wherein said clamping means includes a plurality of downwardly extending resilient fingers disposed in close array along the corresponding jaw, and means defining a clamping surface of each said fingers facing the web-engaging face of the corresponding jaw.

4. Apparatus according to claim 2, wherein said clamp actuating means include camming means mounted in a fixed location in said loading chamber, said clamping means comprising a cam-engaging element for engaging said camming means, said camming means comprising cam surface means engaging said cam-engaging element to cause the clamping means to move from said first towards said second position thereof in response to movement of the corresponding jaws from their said closed position and to assume and remain in second position upon continued movement of the jaws toward their said open position, said clamping means further comprising spring means for biassing the clamping means towards said first position thereof.

5. Apparatus according to claim 2, comprising jaw guide means mounting said jaws in said loading chamber, said jaw guide means being inclined downwardly toward a central vertical transverse plane of said loading chamber, whereby movement of the jaws of the or each pair toward that plane is correspondly inclined.

6. Apparatus according to claim 2, wherein each of the jaws for holding open a said end web portion comprises a base member and a web-engaging element secured to the base member, said web-engaging element being of a resilient, fungus-resistant, rubbery or gelatinous material peelably adherable to said wrapping material.

7. Apparatus according to claim 2, wherein each jaw is free of projection toward the other jaw of the same pair in and below said web-engaging face whereby said length of tubular material engaged by said face extends substantially vertically downwards therefrom.

8. Apparatus according to claim 1, wherein said pack support means comprises a table unit, said table unit being a said pack-forming element; means mounting said table unit in said loading chamber below said holding means, said table mounting means comprising a plurality of fixed flexible elongate elements arranged in tension and extending generally vertically; two freely rotatable members carried by, and spaced apart horizontally on, each of at least two opposite sides of the table unit, each said elongate element passing over one of the two rotatable members on the corresponding side of said table unit and under the other, whereby said table unit is supported by said elongate elements but free to be moved vertically with respect thereto with rotation of said rotatable members on said elongate members, said apparatus further comprising table drive means coupled to said table unit for moving said table unit vertically in said loading chamber.

9. Apparatus according to claim 1, wherein said releasable first clutch is of a torsion spring kind comprising a driving member and a driven member, rotatable relative to each other; a torsion clutch spring fixed to a first of said members; a sleeve portion of the other of said members, said spring being in releasable frictional driving engagement around said sleeve portion; and an actuating member mounted movably on one of said members in engageable juxtaposition with said spring, for permitting said spring and sleeve portion to assume said frictional driving engagement.

10. Apparatus according to claim 1, comprising at least one releasable further clutch, coupling at least one said pack-forming element with said power unit, electrical actuating means for said further clutch, a movable element coupled with, and operable by, at least a clutch other than the clutch to which said pack-forming element is coupled, the electrical control means of said at least one pack-forming element comprising further electrical switching means electrically connected with said further clutch actuating means and disposed in actuable relationship with said movable element, whereby the latter can operate said further switching means to engage said further clutch.

11. Apparatus according to claim 10, wherein a said pack-forming element is defined by ejector means for removing each completed pack in succession from the pack support means, said ejector means including an ejector body, a pack-engaging element of the ejector body, and drive-engaging means of the ejector body, said apparatus further comprising a reciprocable ejector drive element, means coupling said ejector drive element with the output side of a said further clutch; and support means mounting said ejector body movably in a straight path thereon, said coupling means being arranged to convert rotary motion of said further clutch to reciprocating motion of said ejector, whereby said pack engaging element is driven in said straight path in a forward stroke across and away from the pack support means, for removal of a pack therefrom to a location remote from said loading chamber, and a return stroke to retract the ejector.

12. Apparatus according to claim 11, comprising an enclosed cabinet defining said loading chamber therein; means mounting said holding means in an upper portion of said loading chamber; further means mounting said pack support means in said loading chamber below said holding means; means defining an ejection opening of the cabinet in alignment with said straight path of the ejector for ejection of completed packs by the ejector through said opening; means defining a pack support surface in a fixed location extending below said straight path from said loading chamber to said opening; an openable door closing said opening; and means coupling said door with the ejector means whereby to open said door in response to movement of said ejector means in said forward stroke thereof, and to close said door in response to movement of said ejector means in said return stroke.

13. Apparatus according to claim 10, wherein said pack support means comprises a table unit, said table unit being a said pack-forming element, said apparatus further comprising means vertically movably mounting said table unit in said loading chamber below said holding means, and table drive means coupled to said table unit for moving said table unit vertically in said loading chamber; said table drive means comprising a winch, and an elongate flexible member connected with said table unit, extending around said winch, and rotatably coupled with said power unit through a said releasable further clutch.

14. Apparatus according to claim 13, wherein said table drive means further comprises a releasable brake coupled with said winch for rotation therewith and for controlling downward movement of the table unit under gravity when said releasable further clutch is disengaged.

15. Apparatus according to claim 13, wherein said table drive means further comprises a lift lever, means pivoting said lift lever engageably adjacent a cam of said cam means, for movement in response to rotation of said cam, and a lifting element of said lift lever engaged by said elongate flexible member whereby, upon the lever executing said pivotal movement, an upward pull is exerted by said lifting element on said elongate flexible member so as to lift the table unit by a limited predetermined amount.

16. Apparatus according to claim 10 wherein at least one said releasable further clutch is of a torsion spring kind comprising a driving member and a driven member rotatable relative to each other; a torsion clutch spring fixed to a first of said members; a sleeve portion of the other of said members, said spring being in releasable frictional driving engagement around said sleeve portion; and an actuating member mounted on one of said members in engageable juxtaposition with said spring, for permitting said spring and sleeve portion to assume said frictional driving engagement.

17. Apparatus according to claim 1, comprising electrical actuating means of said first clutch and means coupling at least one first said pack-forming element with said cam means whereby rotation of said cam means directly actuates the pack-forming element, the electrical control means for said at least one first pack-forming element comprising at least said first said clutch actuating means.

18. Apparatus according to claim 17, comprising a releasable second clutch, coupling at least one second said pack-forming element with said power unit, and electrical actuating means of said second clutch, the electrical control means of said at least one second pack-forming element comprising second electrical switching means electrically connected with said second clutch actuating means and disposed in actuable relationship with at least a said first pack-forming element whereby the latter can operate said second switching means to engage said second clutch.

19. Apparatus according to claim 18, comprising a releasable third clutch, coupling at least one said pack-forming element with said power unit, and electrical actuating means of said third clutch, the electrical control means of said at least one pack-forming element comprising electrical switching means electrically connected with said third clutch actuating means and disposed in actuable relationship with a said pack-forming element actuable through at least one of the other clutches, whereby the last-mentioned pack-forming element can operate the switching means connected with said third clutch actuating means to engage said third clutch.

* * * * *